US006549734B2

(12) United States Patent
Yamada et al.

(10) Patent No.: US 6,549,734 B2
(45) Date of Patent: Apr. 15, 2003

(54) IMAGE FORMING APPARATUS HAVING AN INDICATOR FOR INDICATING PUNCH HOLE TYPES

(75) Inventors: Kenji Yamada, Tokyo (JP); Shinji Asami, Tokyo (JP); Junichi Iida, Tokyo (JP); Hiroki Okada, Tokyo (JP); Hiromoto Saitoh, Tokyo (JP); Nobuyoshi Suzuki, Tokyo (JP); Takeshi Sasaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/984,090

(22) Filed: Oct. 26, 2001

(65) Prior Publication Data

US 2002/0051651 A1 May 2, 2002

(30) Foreign Application Priority Data

Oct. 31, 2000 (JP) ..... 2000-333452

(51) Int. Cl.[7] ..... B65H 37/04; G03G 15/00

(52) U.S. Cl. ..... 399/81; 270/58.07; 399/82; 399/407

(58) Field of Search ..... 399/81, 82, 85, 399/45, 407; 270/58.07

(56) References Cited

U.S. PATENT DOCUMENTS

| | | | | |
|---|---|---|---|---|
| 5,020,784 A | | 6/1991 | Asami et al. | 270/58.11 |
| 5,263,697 A | | 11/1993 | Yamazaki et al. | 270/58.08 |
| 5,320,336 A | | 6/1994 | Asami | 270/58.08 |
| 5,461,469 A | * | 10/1995 | Farrell et al. | 399/81 X |
| 5,508,798 A | | 4/1996 | Yamada | 399/410 |
| 5,561,535 A | * | 10/1996 | Katoh et al. | 399/83 X |
| 5,570,877 A | | 11/1996 | Asami et al. | 271/186 |
| 5,655,765 A | | 8/1997 | Asami et al. | 271/185 |
| 5,762,328 A | | 6/1998 | Yamada et al. | 270/58.08 |
| 5,788,229 A | | 8/1998 | Asami et al. | 271/305 |
| 6,029,026 A | * | 2/2000 | Natsume et al. | 270/58.07 |
| 6,145,825 A | | 11/2000 | Kunihiro et al. | 270/58.09 |
| 6,199,853 B1 | | 3/2001 | Andoh et al. | 270/58.14 |
| 6,231,045 B1 | | 5/2001 | Yamada et al. | 271/292 |
| 6,264,191 B1 | | 7/2001 | Suzuki et al. | 271/189 |
| 6,296,247 B1 | | 10/2001 | Tamura et al. | 271/214 |
| 6,322,070 B2 | | 11/2001 | Yamada et al. | 271/293 |
| 6,325,585 B1 | * | 12/2001 | Sasaki et al. | 399/407 X |
| 6,394,448 B2 | | 5/2002 | Suzuki et al. | 271/189 |

FOREIGN PATENT DOCUMENTS

| | | | |
|---|---|---|---|
| JP | 7-267481 | | 10/1995 |
| JP | 9-136762 | | 5/1997 |
| JP | 10-6290 | | 1/1998 |
| JP | 11-102142 | * | 4/1999 |
| JP | 2000-153955 | | 6/2000 |
| JP | 2001-047398 | * | 2/2001 |
| JP | 2001-048415 | * | 2/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus including an image forming device and a post-processing device having a punching device that forms punch holes of a plurality of types to a paper ejected from the image forming device. The image forming apparatus also includes an indicator. The indicator indicates one of pictographs corresponding to each of punch hole types and indicates an indicated pictograph as a pictograph different from the previous pictograph when the indicated pictograph is selected. Or alternatively, the indicator indicates each of the punch hole types and also indicates a plurality of pictographs different from each other and indicates a pictograph corresponding to a selected punch hole type as a pictograph different from the previous pictograph when the punch hole type is selected.

10 Claims, 19 Drawing Sheets

IMAGE FORMING APPARATUS HAVING AN INDICATOR FOR INDICATING PUNCH HOLE TYPES

BACKGROUND OF THE INVENTION

1. Technical Field

The present invention relates to an image forming apparatus, and more particularly, to an image forming apparatus such as a copier, a printer and a facsimile provided with a device that performs post-processing to form a punch hole for filing.

2. Related Art

For example, in the image forming apparatus such as the copier, various types of paper processing devices that perform processing such as sorting and stapling papers, on which an image is recorded by the image forming apparatus, punching for filing, stamping and adding information to the papers have been conventionally provided.

Many paper processing devices have been equipped with a device that performs punching for filing, that is, a punching device that performs punch processing.

There are various kinds of punch holes. For example, typical punch holes are a two-hole punch, a three-hole punch and a four-hole punch that can be seen in Japan and Europe. Regarding the paper, papers of an A4 and an A3 size are widely used in Japan and Europe, and papers of a legal size are widely used in North America. Although there are the same two-hole punch and three-hole punch, hole positions are different among Japan, Europe and North America. Punching devices are proposed in Japanese Patent Laid-Open No. Hei 9-136762 and No. Hei 10-6290 in which the punching devices are arranged at both of the two-hole punch position and the three-hole punch position in order to correspond to the two-hole punch and the three-hole punch by driving only the punching device desired.

Furthermore, in Japanese Patent Laid-Open No. Hei 7-267481, there is proposed a punching device that detects the size and the direction of paper and displays a sentence meaning punching cannot be performed if punching is impossible, and that informs a user of changing the paper size and direction by the sentence.

However, punching types are not frequently switched in normal filing. For example, in North America, the three-hole punch is used in regular filing, and the two-hole punch is used in the limited case of filing material to a public organization. The two-hole punch is used little, and the frequency of switching between the two-hole punch and the three-hole punch is very small. The user has to pay attention to the setting of desired punch hole type and confirm a caution by the sentence every time he/she uses the punching device, and thus an operation becomes complicated and leads to the possibility of causing copying mistake.

SUMMARY OF THE INVENTION

The object of the present invention is to provide an image forming apparatus with improved convenience.

To achieve the foregoing object, the image forming apparatus of the present invention comprises: an image forming device; and a post-processing device having a punching device that forms punch holes of a plurality of types on the paper ejected from the image forming device. The image forming apparatus also comprises an indicator. The indicator indicates one of pictographs corresponding to each punch hole types, and when the indicated pictograph is selected, it indicates the indicated pictograph in a pictograph different from the one indicated before.

Furthermore, to achieve the foregoing object, the image forming apparatus of the present invention comprises: the image forming device; and the post-processing device having the punching device that forms punch holes of a plurality of types on the paper ejected from the image forming device. The image forming apparatus also comprises the indicator. The indicator indicates each of the punch hole types and a plurality of different kinds of pictographs, and when a punch hole type is selected, it indicates the pictograph corresponding to the selected punch hole type as the pictograph different from the one indicated before.

Furthermore, to achieve the foregoing object, the image forming apparatus of the present invention comprises: the image forming device; and the post-processing device having the punching device that forms punch holes of a plurality of types on the paper ejected from the image forming device. The image forming apparatus also comprises: the indicator; and a device to control the image forming device, the post-processing device and the indicator. The controller allows the indicator to indicate one pictograph corresponding to a punch hole type among the pictographs regarding the punch hole types on the indicator, and when the punch hole type corresponding to the pictograph is selected, the controller indicates the pictograph in a pictograph different from the one indicated before, and then the controller allows the punching device to form the punch holes corresponding to the selected punch hole type.

Still further, to achieve the foregoing object, the image forming apparatus of the present invention comprises: the image forming device; and the post-processing device having the punching device that forms punch holes of a plurality of types on the paper ejected from the image forming device. The image forming apparatus also comprises: the indicator; the image forming device; and a device to control the post-processing device and the indicator. The controller allows the indicator to indicate a plurality of the pictographs, which are related to each of a plurality of the punch hole types executed by the punching device and are different from each other, and when a punch hole type is designated, the indicator indicates the pictograph related to the designated punch hole type in a pictograph different from the one indicated before, and then the controller allows the punching device to form the punch holes corresponding to the designated punch hole type.

Other objects will be clarified by the drawings and description made in reference to the drawings.

BRIEF DESCRIPTION OF THE DRAWINGS

FIG. 1 to FIG. 11 show an embodiment of the image forming apparatus of the present invention in which:

FIG. 1 is a front view of the punching device, a part of which is broken, in the paper post-processing device;

FIG. 2 is an enlarged front view of a part of the punching device, partially shown in section;

FIG. 3 is an enlarged sectional view along the X—X line of FIG. 2;

FIG. 4 is an enlarged sectional view of a punching mechanism along the Y—Y line of FIG. 2;

FIG. 5 is a plan view of the paper to which the three-hole punching is performed by the punching device;

FIG. 6 is a plan view of the paper to which the two-hole punching is performed by the punching device;

FIG. 7 is a plan view of the paper to which the five-hole punching is performed;

FIG. 8 is an explanatory view showing a constitution of the paper post-processing device;

FIG. 9 is an explanatory view showing a constitution of the controller in the paper post-processing device with that of the image forming device;

FIG. 10 is an explanatory view showing a constitution of a body operation section of the image forming device and images indicated on the indicator of the body operation section; and FIG. 11 is a view showing an indication process of the punch hole types.

FIG. 13 and FIG. 14 concern another embodiment of the image forming apparatus of the present invention, in which:

FIG. 13 is an explanatory view showing a constitution of the body operation section of the image forming device and the images indicated on the indicator of the body operation section; and FIG. 14 is an explanatory view showing an indication process of the punch hole types.

FIG. 15 and FIG. 16 concern still another embodiment of the image forming apparatus of the present invention, in which:

FIG. 15 is an explanatory view showing a constitution of the body operation section of the image forming device and the images indicated on the indicator of the body operation section; and FIG. 16 is an explanatory view showing an indication process of the punch hole types.

FIG. 17 to FIG. 21 concern still another embodiment of the image forming apparatus of the present invention, in which:

FIG. 17 is an explanatory view showing the paper post-processing device in the image forming apparatus;

FIG. 18 is an explanatory view showing a constitution of the body operation section of the image forming device and the images indicated on the indicator of the body operation section;

FIG. 19 is an explanatory view showing an indication process of the punch hole types;

FIG. 20 is an explanatory view showing a detection process for an opening state of a door attached to the paper post-processing device; and FIG. 21 is an explanatory view showing a process performed subsequently to the process of FIG. 20.

DETAILED DESCRIPTION OF THE PREFERRED EMBODIMENTS

Embodiments of the image forming apparatus according to the present invention will now be described with reference to the drawings.

The image forming apparatus illustrated and described as the embodiment is a copier.

The copier comprises the image forming device and the paper post-processing device.

The image forming device is a well known device having an image forming process of an electronic photograph method, which consists of sections where an automatic paper selection mechanism detects a document size in accordance with a document sent from an automatic document feeding mechanism or a document placed on a contact glass, the paper fitting the document is fed to the image forming mechanism, and the paper is ejected after to the image forming mechanism makes a copy on the paper. An operation of the image forming device is controlled by an image forming controller in the image forming device.

The paper post-processing device comprises a stapler, the punching device and the like, and it directly ejects the paper ejected from the image forming device to the outside, or forms the punch holes on the paper by the punching device, and alternatively, transfers a plurality of the papers to the stapler and a bunch of papers is bound by the stapler. Operation control of each device is performed by driving the device according to a signal from the image forming controller of the image forming device by a post-processing controller in the paper post-processing device, which includes a microprocessor.

Figure 4:
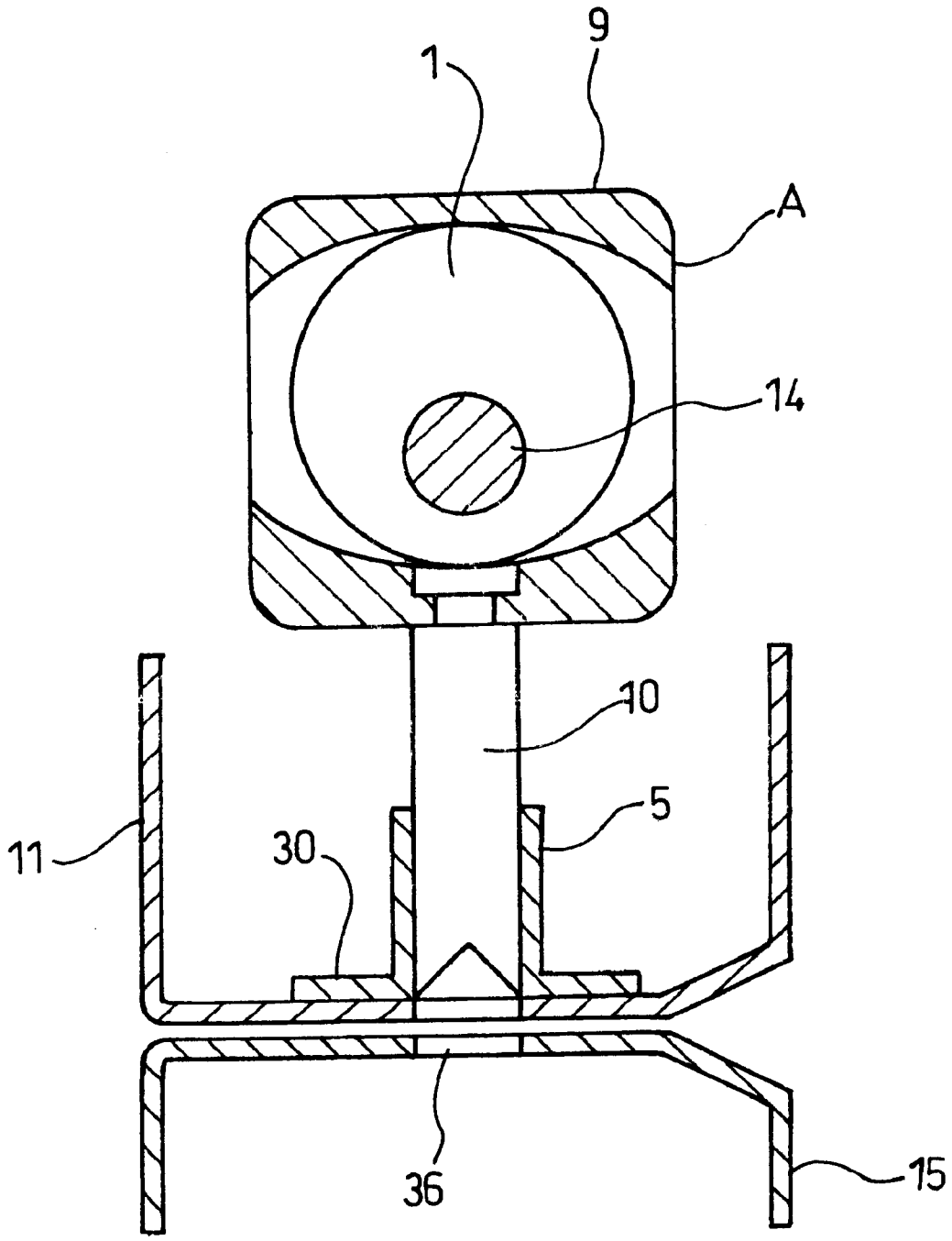

The punching device comprises five punching mechanisms that form five punch holes. Each punching mechanism includes a yoke cam as shown in FIG. 4. A cam 1 is eccentrically arranged to a drive shaft 14, and rotates with the drive shaft 14. The cam 1 is housed in a cam case 9. A punch 10 is attached to the cam case 9. A pin guide 5 is for guiding a vertical movement of the punch 10, and is fixed to an upper frame 11 by a pin guide bracket 30.

The paper to be punched is inserted in a gap between the bottom surface of the upper frame 11 and an upper surface of a lower frame 15. When the drive shaft 14 is rotated by an angle of 360°, the cam case 9 is reciprocally moved, and the punch 10 moves vertically toward a punching base hole 36 provided in the lower frame 15, and thus the punch 10 makes a hole in the paper.

Figure 1:
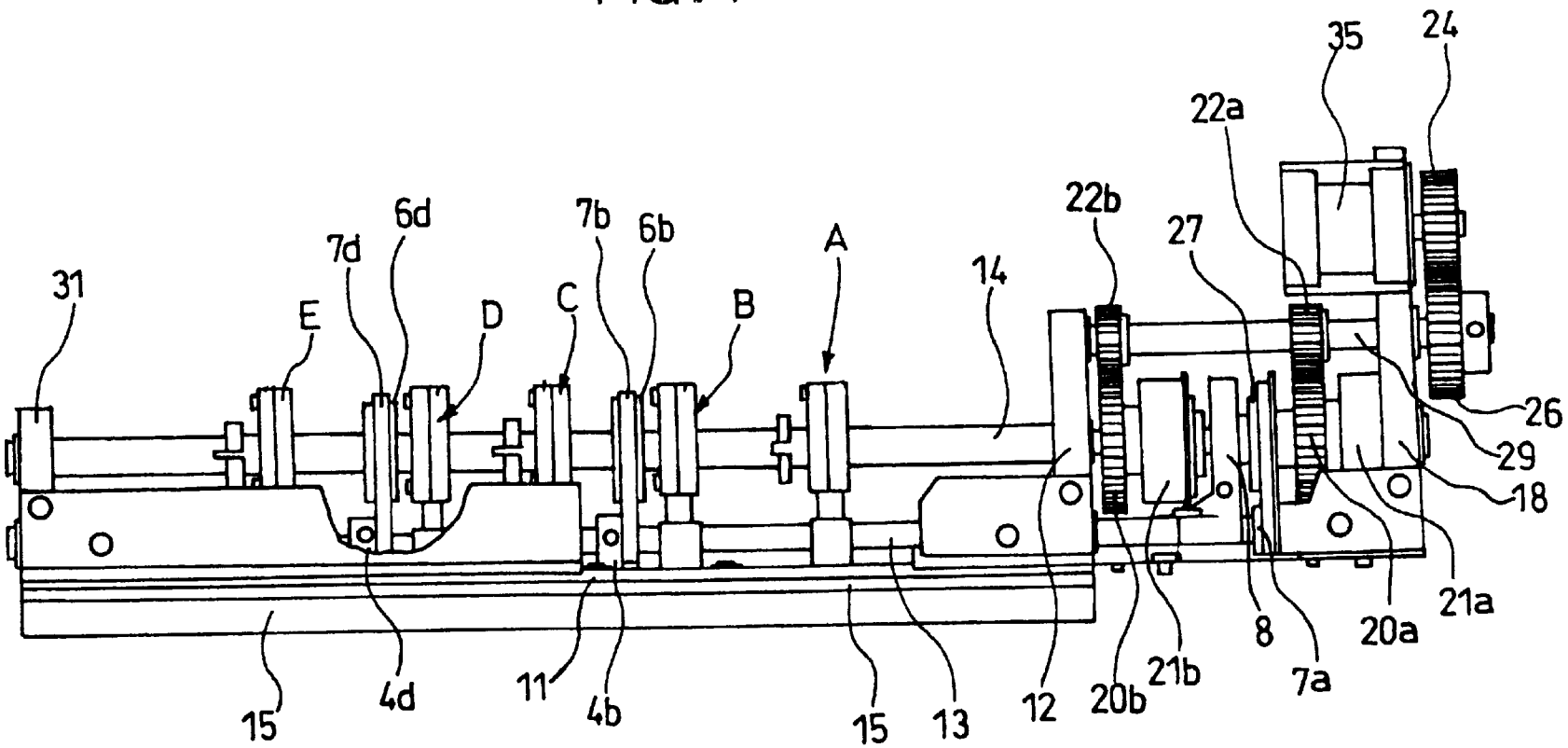
Figure 2:
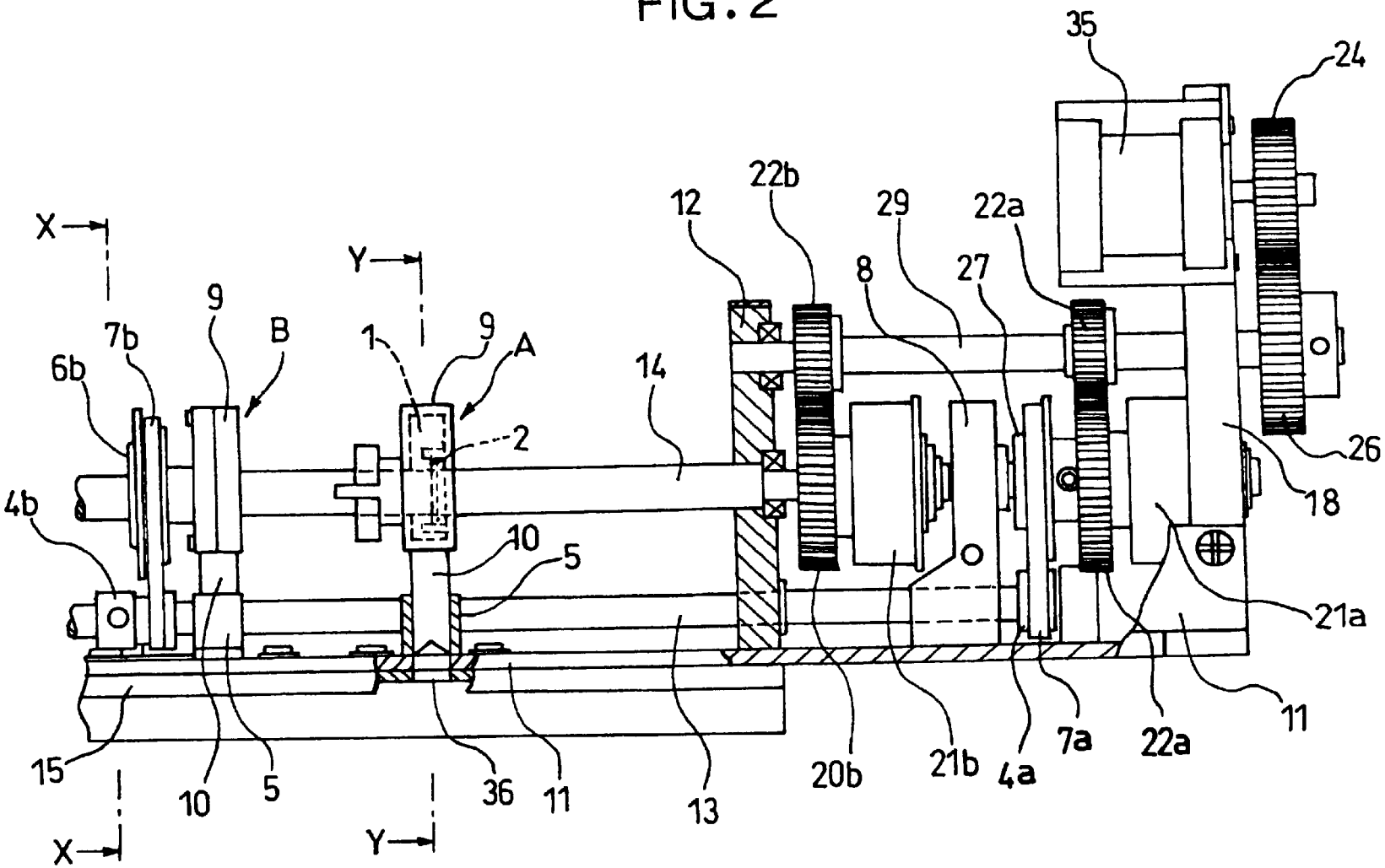
Figure 3:
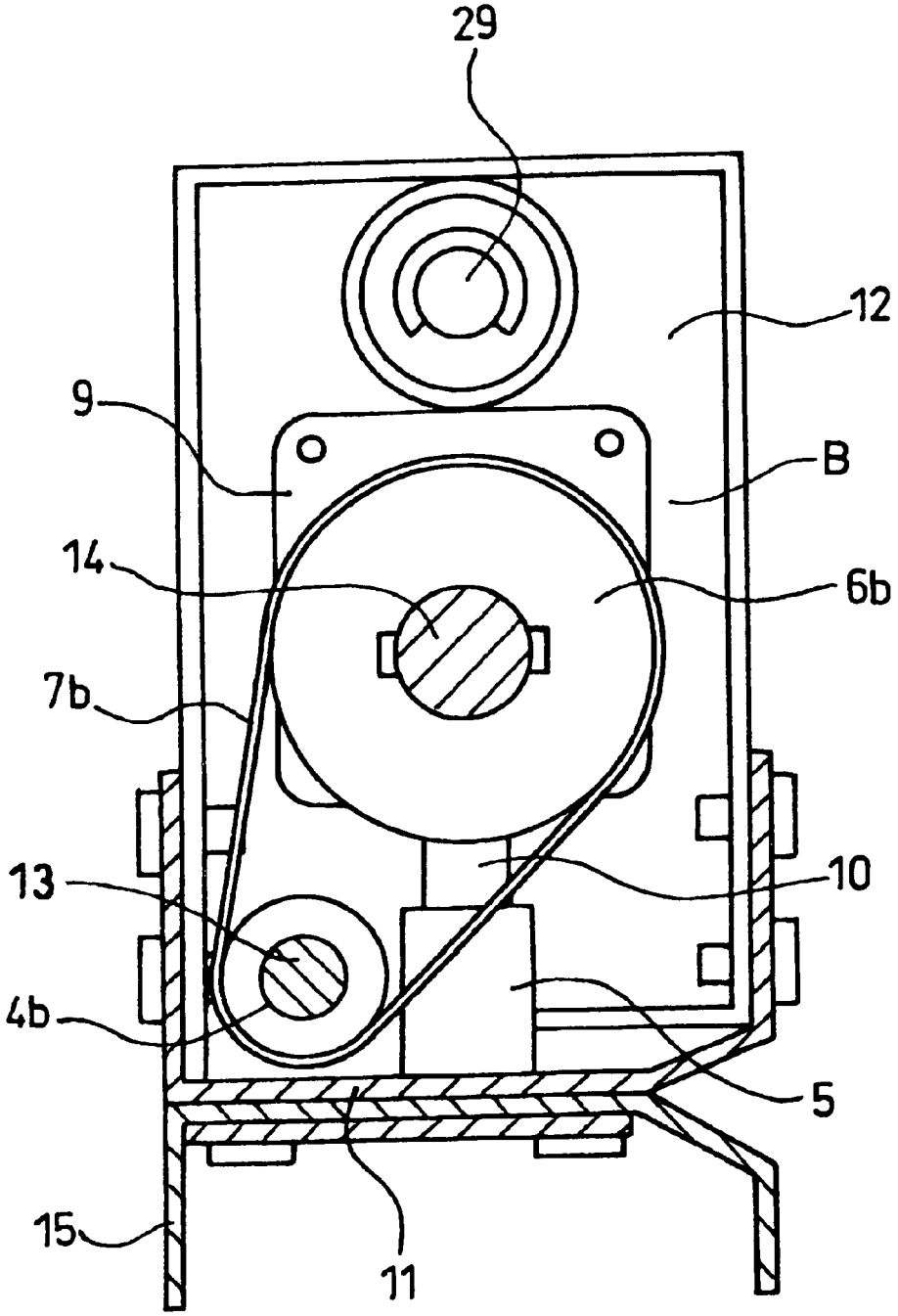

FIG. 1 to FIG. 3 show the punching device in which the punching mechanism is built.

The upper frame 11 and the lower frame 15 constitute a base of the punching device. A rear side plate 18, a rear side plate 12 and front side plate 31 are attached to the upper frame 11.

A drive motor 35 rotates the cam 1 to allow the punch 10 to penetrate the paper inserted between the upper frame 11 and the lower frame 15, and fixes a motor base to the rear side plate 18. The drive shaft 14 is supported by bearings located on the front side plate 31 and the rear side plate 12. An auxiliary drive shaft 13 is arranged parallel with the drive shaft 14, and is supported by bearings located on the front side plate 31, the rear side plate 12 and the rear side plate 18. A clutch drive shaft 29 is arranged parallel with the shafts 14 and 13, and is supported by the bearings located on the rear side plates 12 and 18.

The drive motor 35 is attached with a drive gear 24 to its rotation shaft. A follower gear 26 that engages with the drive gear 24 is attached to the clutch drive shaft 29. The clutch drive shaft 29 has clutch drive gears 22*a* and 22*b*, and the clutch drive gears 22*a* and 22*b* are engaged with clutch follower gears 20*a* and 20*b*.

Electromagnetic clutches 21*a* and 21*b* consist of one-rotation clutches that rotate a following side member by the angle of 360° when one pulse signal is applied in a fixed time to stop the following side member always at the same position.

The electromagnetic clutch 21*b* is supported by a clutch front side plate 8 and the rear side plate 12. The clutch follower gear 20*b* is attached to a driving side member of the electromagnetic clutch 21*b*. The following side member of the electromagnetic clutch 21*b* is connected to the drive shaft 14.

When electric conduction is applied to the electromagnetic clutch 21*b* and the driving side member and the following side member are connected, the drive shaft 14 rotates by the angle of 360°.

The electromagnetic clutch 21*a* is supported by the clutch rear side plate 18 and the clutch front side plate 8. The clutch follower gear 20*a* is attached to the driving side member of the electromagnetic clutch 21*a*. A drive pulley 27 is attached to the following side member of the electromagnetic clutch 21*a*. A cam drive pulley 4*a* is attached to the auxiliary drive shaft 13. A timing belt 7*a* is wound around the cam drive pulley 4*a* and the drive pulley 27.

When electric conduction is applied to the electromagnetic clutch 21*b* and the driving side member and the following side member are connected, the auxiliary drive shaft 13 rotates by the angle of 360°.

Further, cam drive pulleys 4*b* and 4*d* are provided to the auxiliary drive shaft 13 with a distance. Cam pulleys 6*b* and 6*d* are provided to the drive shaft 14 so as to correspond to the cam drive pulleys 4*b* and 4*d*. Timing belts 7*b* and 7*d* are severally wound to the cam drive pulleys 4*b*, 4*d* and the cam pulleys 6*b*, 6*d*.

Punching mechanisms A to E shown in FIG. 4 are provided to the drive shaft 14.

Among the punching mechanisms A to E, three punching mechanisms A, C and E are connected to the drive shaft 14 by a pin 2 to rotate with the drive shaft 14. Other punching mechanisms B and D are attached to the drive shaft 14 such that the cam 1 does not rotate even if the drive shaft 14 rotates. The cam pulleys 6*b* and 6*d* are attached to the cams 1 of punching mechanisms B and D.

Figure 5:
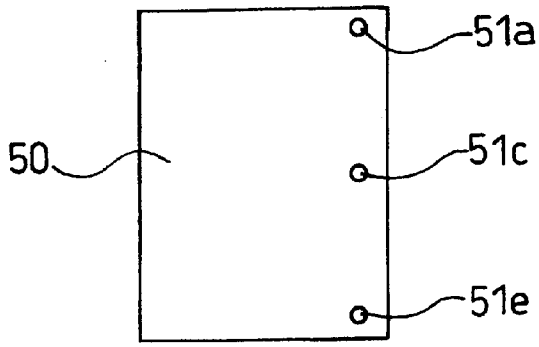

When electric conduction is applied to the electromagnetic clutch 21*b*, the drive shaft 14 rotates once and the cams 1 of punching mechanisms A, C and E rotate by the angle of 360°. The punch 10 forms three punch holes 51*a*, 51*c* and 51*e* in a paper 50 as shown in FIG. 5.

Figure 6:
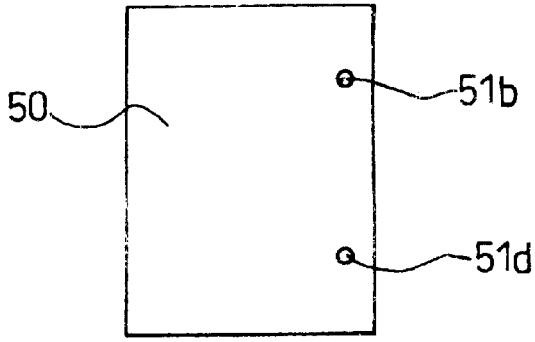

When electric conduction is applied to the electromagnetic clutch 21*a*, a rotation of the auxiliary drive shaft 13 is transmitted to the cam drive pulleys 4*b*, 4*d*, the timing belts 7*b*, 7*d* and the cam pulleys 6*b*, 6*d*, and the cams 1 of punching mechanisms B and D rotate by the angle of 360°. The punch 10 forms two punch holes 51*b* and 51*d* in the paper 50 as shown in FIG. 6.

Figure 7:
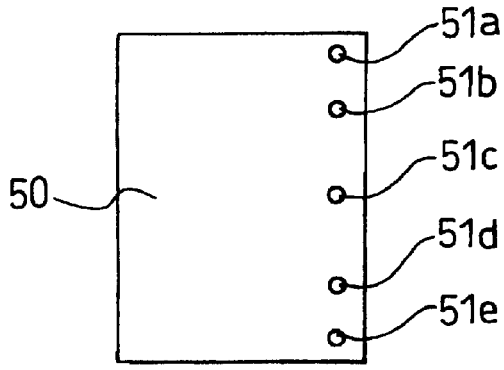

Furthermore, when electric conduction is applied to the both electromagnetic clutches 21*a* and 21*b*, the drive shaft 14 and the auxiliary drive shaft 13 rotate, and the cams 1 of all punching mechanisms A to E rotate by the angle of 360°. All punches 10 form five punch holes Sib and Sid in the paper 50 as shown in FIG. 7. Note that in the punching device, timing of electric conduction to the two electromagnetic clutches 21*a* and 21*b* is staggered in order to reduce punching load torque applied to the drive source 35.

Figure 8:
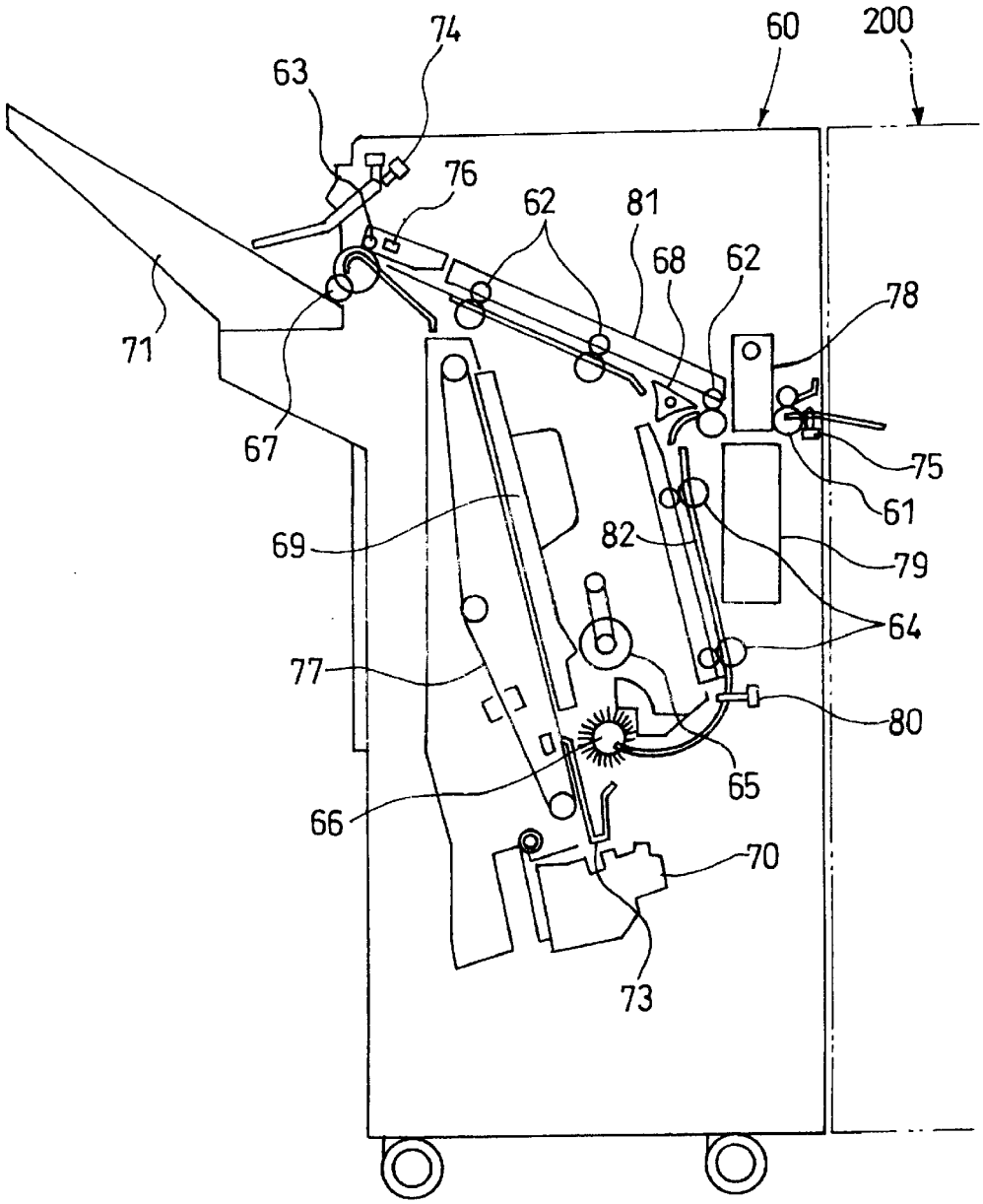

The punching device is installed inside a paper post-processing device 60 shown in FIG. 8.

The paper post-processing device 60 is arranged adjacently to an image forming device 200 making its transfer port aligned with a paper ejection path of a copier body as the image forming apparatus or the image forming device 200.

At the transfer port of the paper post-processing device 60, a paper ejection sensor 75 to detect carrying-in of the paper, an entrance roller 61 to carry the paper inside, and a punching device 78 are provided. A punch crumb case 79 to catch punch crumbs, which are made when the punch holes are formed, is provided below the punching device 78. A transfer guide 81 is arranged between the punching device 78 and a paper ejection tray 71. A divergent claw 68 is provided between the punching device 78 and the transfer guide 81. The divergent claw 68 switches the transfer path of the paper passing the punching device 78, and it guides the paper ejected from the image forming device 200 to the transfer guide 81 or a stapler 70.

On the transfer guide 81, there are provided: plural pairs of upper transfer rollers 62 to transfer the paper from the divergent claw 68 to the paper ejection tray 71; an ejection sensor 76 to detect the paper transferred by the pairs of upper transfer rollers 62; a pair of ejection rollers 63 to eject the paper on the paper ejection tray 71; a shape roller 67 to collect the papers on a predetermined position of the paper ejection tray 71; a paper surface sensor 74 to detect the paper on the paper ejection tray 71; and the like. A pair of the upper transfer rollers (62) are also provided between the punching device 78 and the divergent claw 68.

The paper ejection tray 71 is designed to be movable vertically and horizontally by an elevating motor and a shift motor.

The stapler 70 is arranged below a transfer guide 82. A transfer guide 82 is arranged between the divergent claw 68 and the stapler 70. On the transfer guide 82, there is arranged: plural pairs of lower transfer rollers 64 to transfer the paper guided by the divergent claw 68 to the stapler 70; a transfer sensor 80 to detect the paper transferred by the pairs of lower transfer rollers 64; a paper feeding roller 66; and the like.

A staple tray consists of a jogger fence 69 for matching the papers, a return roller 65, a discharge belt 77 for ejecting a bound bunch of papers, and the like, and is arranged obliquely in the paper post-processing device 60 with one end directing to the stapler 70 and the other end directing to an exit side of the transfer guide 81. A rear end fence 73 is arranged between the bottom end of staple tray and the stapler 70.

Figure 9:
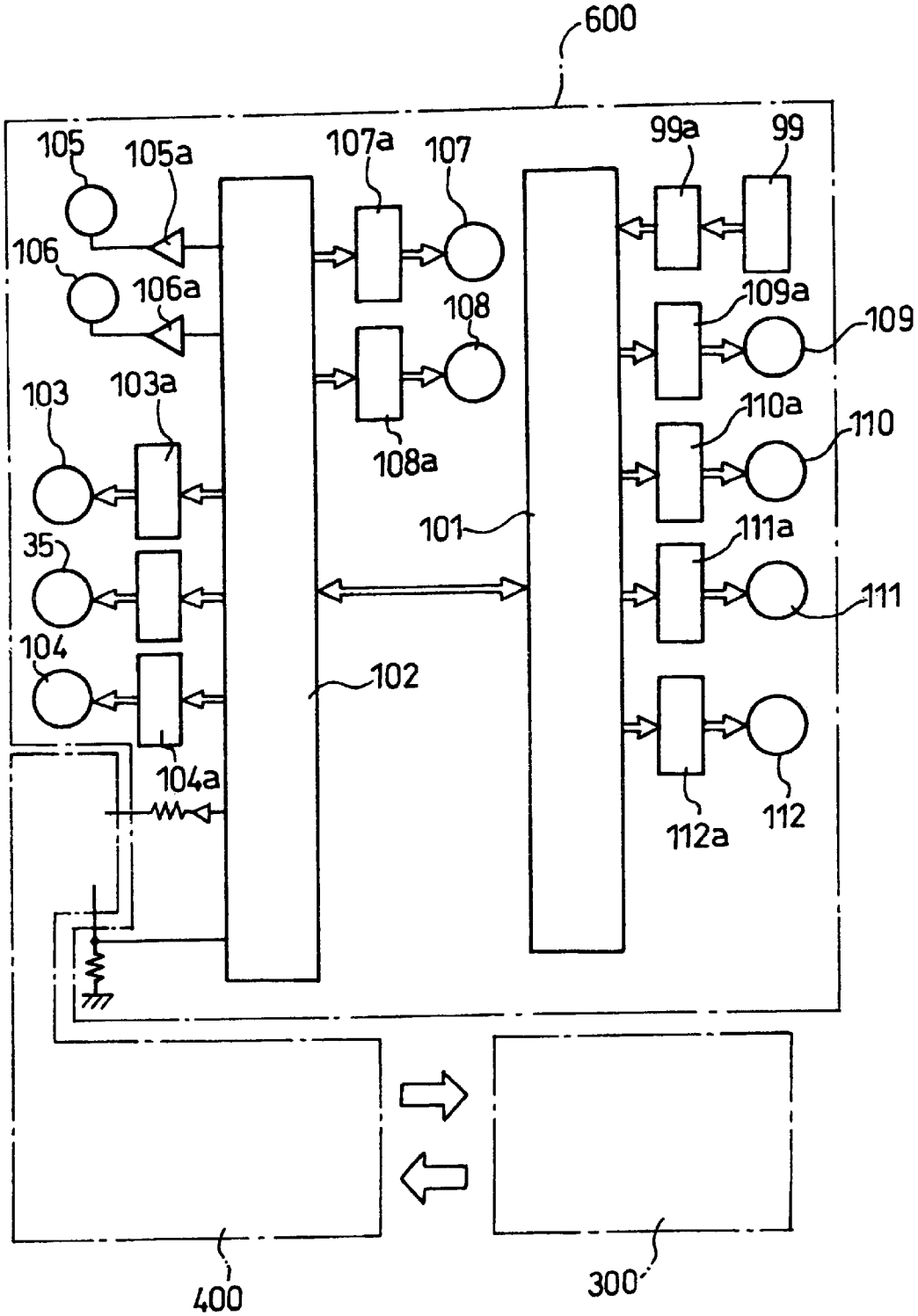

FIG. 9 shows the controller of the image forming apparatus. The controller comprises: a post-processing controller 600 of the paper post-processing device 60; and an image forming controller 400 of the image forming device 200. Reference numeral 300 shows a body operation section 300 in the image forming device 200.

The post-processing controller 600 includes an interface circuit 101 and a control circuit 102.

Each sensor and each switch in the paper post-processing device 60 are connected to the interface circuit 101. The sensors and switches are shown by one block 99, and it is connected to the interface circuit 101 via a driver circuit 99*a*. Furthermore, a staple motor 109 to drive the stapler 70, a discharge motor 110 to drive the discharge belt 77, a staple moving motor 111 to move the stapler 41, and a jogger motor 112 to move the jogger fence 69 are connected to the interface circuit 101 via driver circuits 109*a*, 110*a*, 111*a* and 112*a*.

The control circuit 102 includes a microprocessor, and a vertical motor 103 to elevate the paper ejection tray 71, a shift motor 104 to move the paper ejection tray 71 horizontally, the drive motor 35 of the punching device 78, a solenoid 105 to perform switching operation of the divergent claw 68, a tapping solenoid 106 to drive the return roller 65, a transfer motor 107 to drive rollers of a transfer system such as the pairs of upper transfer rollers 62 and the pairs of lower transfer rollers 64, and a paper ejection motor 108 to drive the shape roller are connected to the control circuit 102 via driver circuits 103*a*, 104*a*, 105*a*, 106*a*, 107*a* and 108*a*.

The control circuit 102 is further connected to the image forming controller 400 of image forming device 200. The body operation section 300, which performs setting of a number of copies, setting of enlargement or reduction of the document, setting of double-side copy, setting of punching or staple binding, and the like, is provided to the image forming device 200. The body operation section 300 is connected to the image forming controller 400.

The image forming controller 400, similarly to a conventional image forming device 200, is provided with the microprocessor that detects the size of the document sent from the automatic document feeding mechanism or the document placed on the contact glass and controls to feed the paper fitting the document, and a non-volatile memory to store various kinds of conditions, although they are not shown.

The staple binding is performed in such a manner that the user designate it to the body operation section 300 and the image forming controller 400 transmits the designation to the post-processing controller 600. Processor in the control circuit 102 of the post-processing controller 600 activates the solenoid 105, and rotates the divergent claw 68 so as to transfer the paper in the direction of the pairs of the lower transfer rollers 64. The paper 50 ejected from the image forming apparatus 200 is sent into the jogger fence 69 by the pairs of the lower transfer rollers 64, the paper feeding roller 66 and the like, and is stuck onto the rear end fence 73. At this point, the control circuit 102 drives the jogger motor 112 to swing the jogger fence 69, and thus arrange the papers 50. When a predetermined number of papers 50 are arranged on the rear end fence 73, the control circuit 102 drives the stable moving motor 111 and the staple motor 109. The stapler 70 binds the papers 50 at one or two positions while being moved by the staple moving motor 111. When binding ends, the discharge motor 110 is driven to rotate the discharge belt 77, and the bound papers 50 are ejected on the paper ejection tray 71.

Further, if the user does not designate the staple binding to the body operation section 300, the processor of image forming controller 400 transmits it to the post-processing controller 600. The control circuit 102 of post-processing controller 600 activates the solenoid 105 to rotate the divergent claw 68 to the position shown in FIG. 8. The paper 50 is directly ejected on the paper ejection tray 71 by the pairs of upper transfer rollers 62 and a pair of the ejection rollers 63. The paper 50 is ejected on the paper ejection tray 71 by every piece without being bound.

The punching device 78 is arranged at an upstream of the divergent claw 68, and forms the punch holes in the case of binding the papers 50 by the stapler 70 or in the case of directly ejecting the papers on the ejection paper tray 71 without performing staple binding.

Formation of the punch holes is performed in such a manner that transfer of the paper 50 is stopped after moving the paper 50 for a predetermined distance from a front end or a rear end of the transfer direction of paper 50, the punch holes are formed, and the paper 50 are moved again. For example, the post-processing controller 600, when the paper ejection sensor 75 detects the front end of paper, drives the transfer motor 107 to transfer the paper 50 for a distance previously determined according to the paper size and a designated number of punch holes, stops the transfer motor 107, drives the drive motor 35 of the punching device 78 to form the punch hole in the paper 50. When the formation of punch hole is finished, the post-processing controller 600 drives the transfer motor 107 to transfer the paper 50, and then stops the transfer motor 107, drives the drive motor 35 of the punching device 78, and thus forms the second punch hole in the paper 50. Formation of other punch holes is performed in the same manner, and when the formation of punch holes are finished, the post-processing controller 600 activates the transfer motor 107 to transfer the paper 50 to the paper ejection tray 71 or the stapler 41.

Selection of either the two-hole punch or the three-hole punch is made by activating either one of the electromagnetic clutches 21*a* or 21*b* by the post-processing controller 600.

Figure 10:
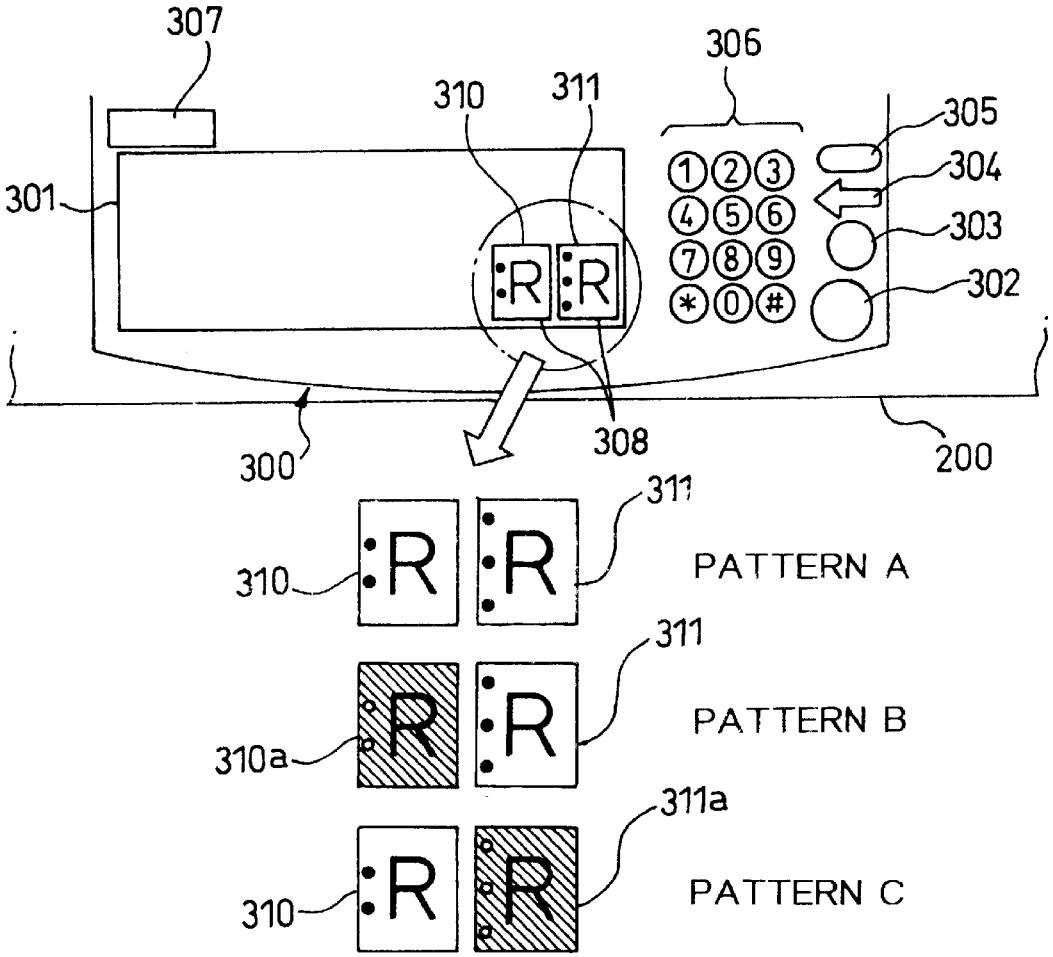

FIG. 10 shows the body operation section 300 in the image forming device 200.

On the body operation section 300, there are arranged: an indicator 301; a start button 302; a stop button 303; a interruption button 304; a reset button 305 to reset the setting of copying conditions or the like; ten keys 306 to set a number of copies, magnification of enlargement/reduction or the like; and an initial setting button 307.

The indicator 301 consists of a liquid crystal display. A copying state, the setting conditions and the like are indicated on the indicator 301, and moreover, a punch hole selection section 308 is indicated. The punch hole selection section 308 is for selecting either the two-hole punch or the three-hole punch to be formed in the paper 50, and consists of a pair of pictographs 310 and 311. Each of the pictographs 310 and 311 consists of a bounding rectangle, letter R and circles showing the punch holes. The circles showing the punch holes are different in every pictograph, one pictograph 310 has two circles, while the other pictograph 311 has three circles.

There are three patterns (A to C) of pictographs 310 and 311 making two pictographs be a pair. When punch hole selection is not made yet, the pictographs 310 and 311 showing the two-hole punch and the three-hole punch are positive images as shown in the pattern A. When the user designates the two-hole punch, the pictograph 310 showing the two-hole punch becomes a pictograph 310*a* with a mesh shade as shown in the pattern B, and the pictograph 311 that has not been selected showing the three-hole punch is in the positive image. When the three-hole punch is designated, the pictograph 311 showing the three-hole punch becomes a pictograph 311*a* with a mesh shade as shown in the pattern C, and the pictograph 310 that has not been selected showing the two-hole punch is in the positive image.

The pattern A is indicated when the image forming apparatus is connected to a power source. The image forming controller 400 of the image forming device 200 indicates the pattern B on the indicator 300 when the user selects the punch hole type, for example, when a liquid crystal touch panel is used as the indicator 301 and the user touches the pictograph 310 with a finger. The image forming controller 400 indicates the pattern C on the indicator 300 when the user touches the pictograph 311. Then, the image forming controller 400 sends information regarding a designated pattern to the post-processing controller 600 of the paper post-processing device 60, and the post-processing controller 600 allows the punching device to form punch holes of the selected punch hole type.

Thus, the indicator 301 indicates the punch hole types that can be formed by pictographs, the user can select the punch hole type from the body operation section 300, and the user can recognize punch holes to be executed at a glance because the pictograph of the designated punch hole type is indicated on the indicator 301 as a pictograph different from that of unselected punch hole type.

Generally, punch having a large pitch such as the three-hole punch can be formed in a long side of the A4 size paper, a letter size paper and the legal size paper. However, the punch cannot be formed in the short side of the A4 size paper, the letter size paper and the legal size paper. The holes at the both ends are chipped if the holes are formed in the latter side.

Accordingly, in this image forming apparatus, the size of paper 50 is determined first to decide whether the designated punch hole type can be formed, the punch hole type is automatically changed if the paper size is inappropriate, and then punching is performed.

Figure 11:
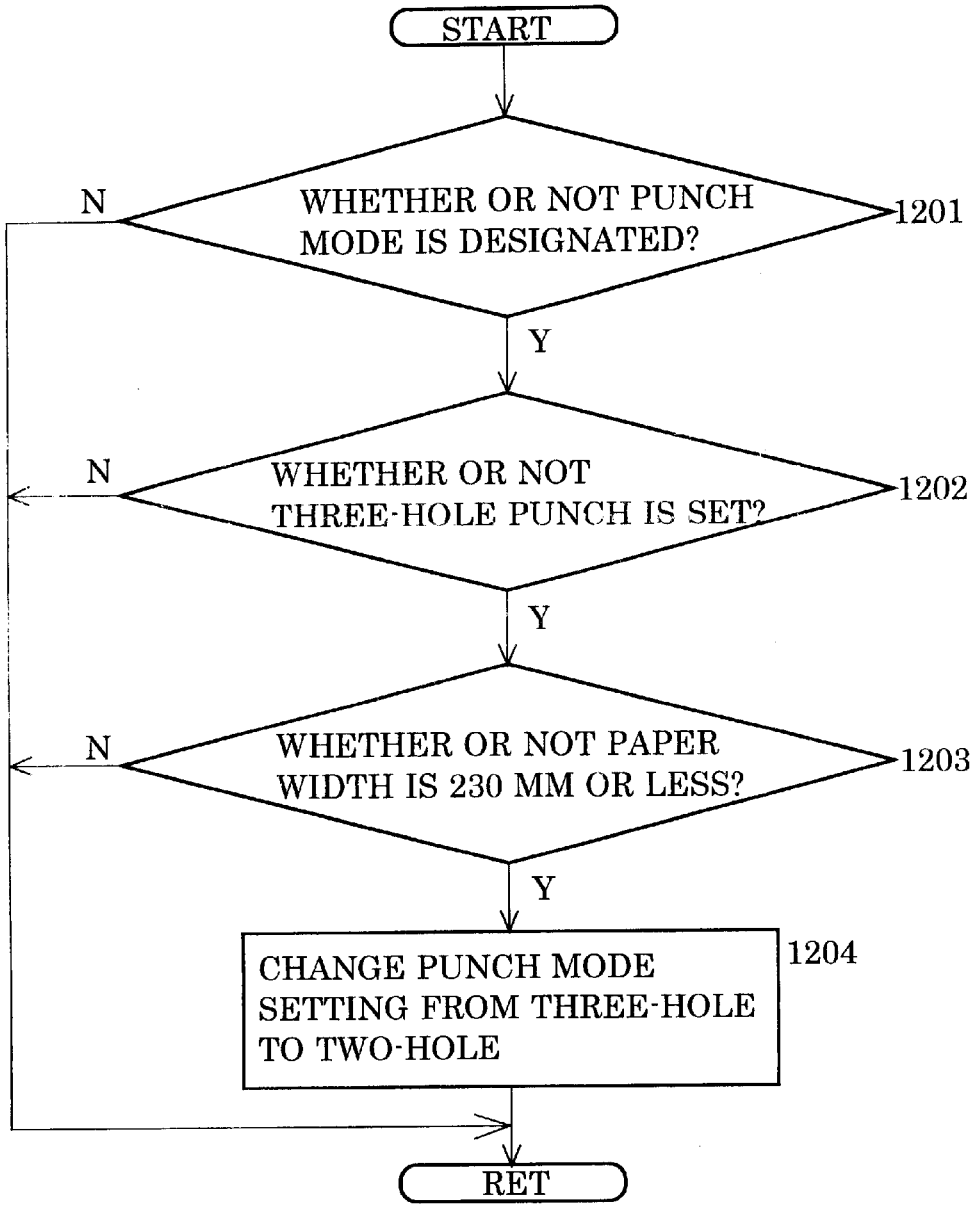

This is performed by the image forming controller 400 of the image forming device 200. FIG. 11 shows a processing of the processor of image forming controller 400.

Firstly, the user sets the document on the automatic document feeding device of the image forming device 200 or on the contact glass, and performs various settings to the body operation section 300. The processor of the image forming controller 400 checks whether a punch mode is designated, that is, whether the user designated formation of punch holes (step 1201). When the punch mode is designated, the image forming controller 400 checks whether the punch hole type is the three-hole punch (step 1202).

If the designated punch hole is the three-hole, the image forming controller 400 checks whether the width of paper is 230 mm or less from the information from the automatic paper selection device of the image forming device 200 or information that the user set to the body operation section 300 (step 1203).

When the paper width is 230 mm or less, the image forming controller 400 changes the setting of punch mode from the three-hole punch to the two-hole punch (step 1204). And then, the image forming controller 400 allows the indicator 301 of the body operation section 300 to indicate the pattern B, and at the same time, allows the post-processing controller 600 to execute the formation of two-hole punch.

Furthermore, if the paper width is 230 mm or more, the image forming controller 400 allows the indicator 301 of the body operation section 300 to indicate the pattern C and allows the post-processing controller 600 to execute the three-hole formation punch.

Note that the reason why the paper width is set to 230 mm or less is that the maximum pitch of three-hole punch in North America is 216 mm and holes of the both end are not chipped when the width is 230 mm.

In the image forming apparatus, as described above, it is judged whether the formation of a selected punch hole type can be performed in the paper size designated by the automatic paper selection device and the body operation section 300, if the judgment is impossible, the punch hole type is automatically changed to the type by which the punch hole can be formed, and a job is executed by the changed punch hole type. For example, when the paper size is A4 and the paper is transported with its short side being parallel with the transfer direction and then the three-hole punch is designated, the image forming apparatus of the present invention automatically changes it to the two-hole punch and transmits its information to the paper post-processing device 60 and executes the two-hole punch. Accordingly, punch holes most suitable for the paper 50 can be formed, and in addition, the user can easily recognize that the punch hole type has been changed in the indicator 301, and thus punch hole formation without an error can be performed.

Furthermore, in the two-hole punch in Japan and the three-hole punch in North America use must be made separately when the paper is transferred with its short side set parallel with the transfer direction, that is, when the paper is transferred lengthwise. In this case, convenience improves if the punch hole type is allocated for every paper size rather than automatically switching the punch hole type.

Figure 12:
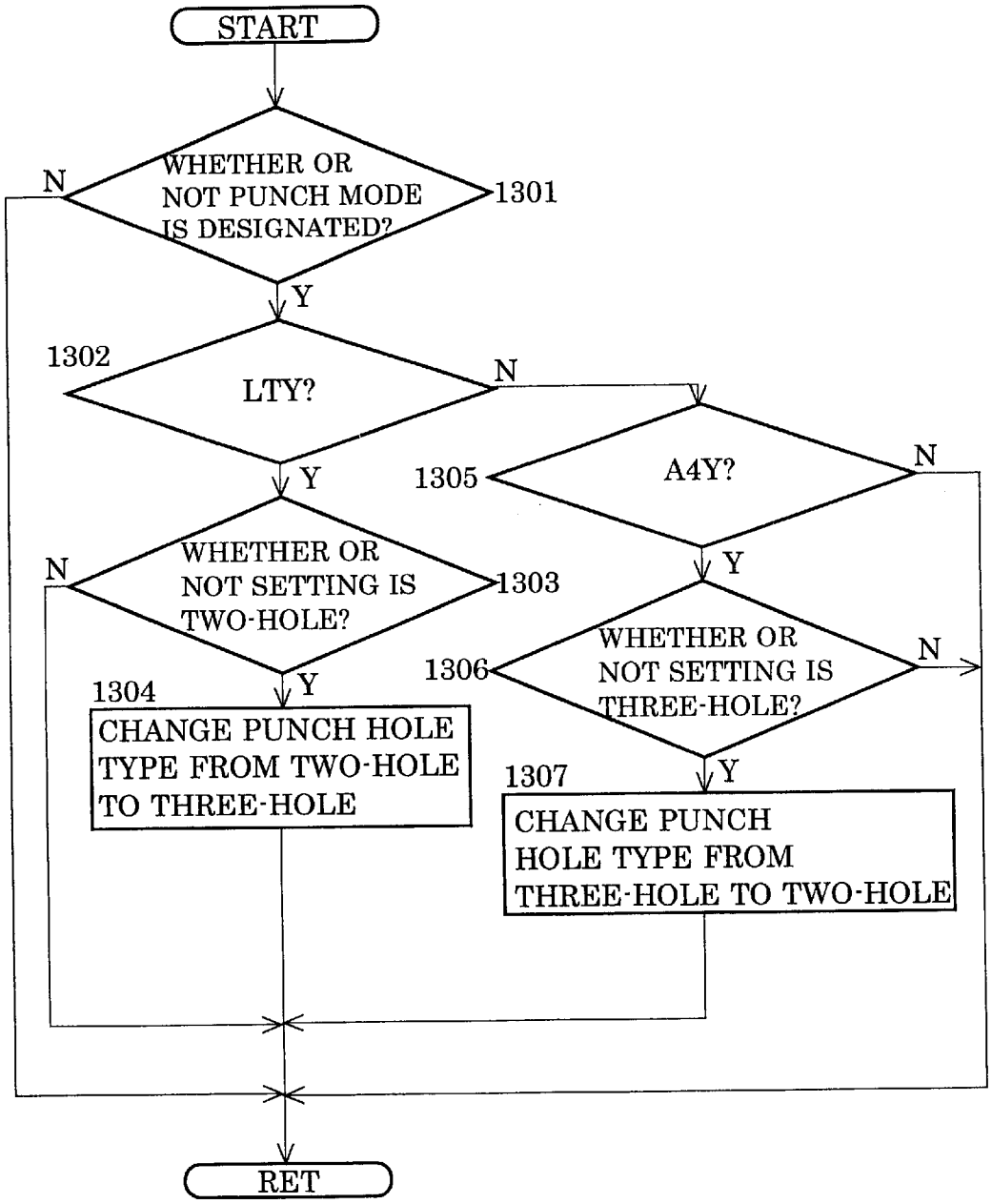
FIG. 12 concerns another embodiment of the image forming apparatus of the present invention, and is an explanatory view showing a punch hole forming process.

FIG. 12 shows a process executed by the image forming controller of the image forming apparatus having such function.

This image forming apparatus is constituted similarly to the image forming apparatus described with reference to FIG. 1 to FIG. 11. However, in this image forming apparatus, the punch hole type is previously set such that the letter size paper transferred lengthwise is for the three-hole punch, the A4 size paper transferred widthwise is for the two-hole punch and the like. The setting information is written in the non-volatile memory of the image forming controller.

The processor of the image forming controller judges between the punch hole type and the paper size when copying is started, automatically changes the punch hole type if necessary, transmits this information to the post-processing controller of the paper post-processing device and changes indication on the indicator.

When the image forming apparatus is connected to the power source, the image forming controller indicates the two-hole punch pictograph and the three-hole punch pictograph in the punch hole selection section of the indicator. Both pictographs are the positive images.

The user sets the document on the automatic document paper feeding device of the image forming device or the contact glass, and selects either the two-hole punch pictograph or the three-hole punch pictograph. When the user presses the start button, the image forming device checks whether the user designated the punch hole type (step 1301). When the punch hole type is designated, the image forming controller 400 checks whether the paper size is the letter size paper of widthwise transfer by the information from the automatic paper selection device of the image forming device 200 or the information set to the body operation section 300 by the user (step 1302), and checks whether the designated punch hole type is the two-hole punch if the paper is the letter size paper of widthwise transfer (1303). If it is the two-hole punch, the designated punch hole type is changed from the two-hole punch to the three-hole punch because the letter size paper of widthwise transfer is set only to the three-hole punch (step 1304). The image forming controller indicates the pictograph, which is the meshed three-hole punch pictograph, on the indicator. Then, the image forming controller sends the changed information to the post-processing controller, and the post-processing controller allows the punching device to execute the three-hole punch.

Further, if the paper is not the letter size of widthwise transfer, the image forming controller checks whether the paper is the A4 size paper of lengthwise transfer (step 1305), and checks whether the designated punch hole type is the three-hole punch if the paper is the A4 size paper of width transfer (step 1306). If the designated punch hole type is the three-hole punch, the image forming controller changes the punch hole type from the thee-hole punch to the two-hole punch because the A4 size paper of widthwise transfer is set to the two-hole punch (step 1307). The image forming controller indicates the pictograph, which is the meshed two-hole punch pictograph, on the indicator. Then, the image forming controller sends the changed information to the post-processing controller, and the post-processing controller allows the punching device to execute the two-hole punch.

Since this image forming apparatus not only indicates the punch hole types that can be performed and indicates the punch hole type that is actually performed in a different pictograph but also automatically performs formation of the most suitable punch hole type even if the A4 size paper or the letter size paper is mixed, and thus a punch failure can be prevented and the punch holes can be formed in accordance with a filing mode.

Figure 13:
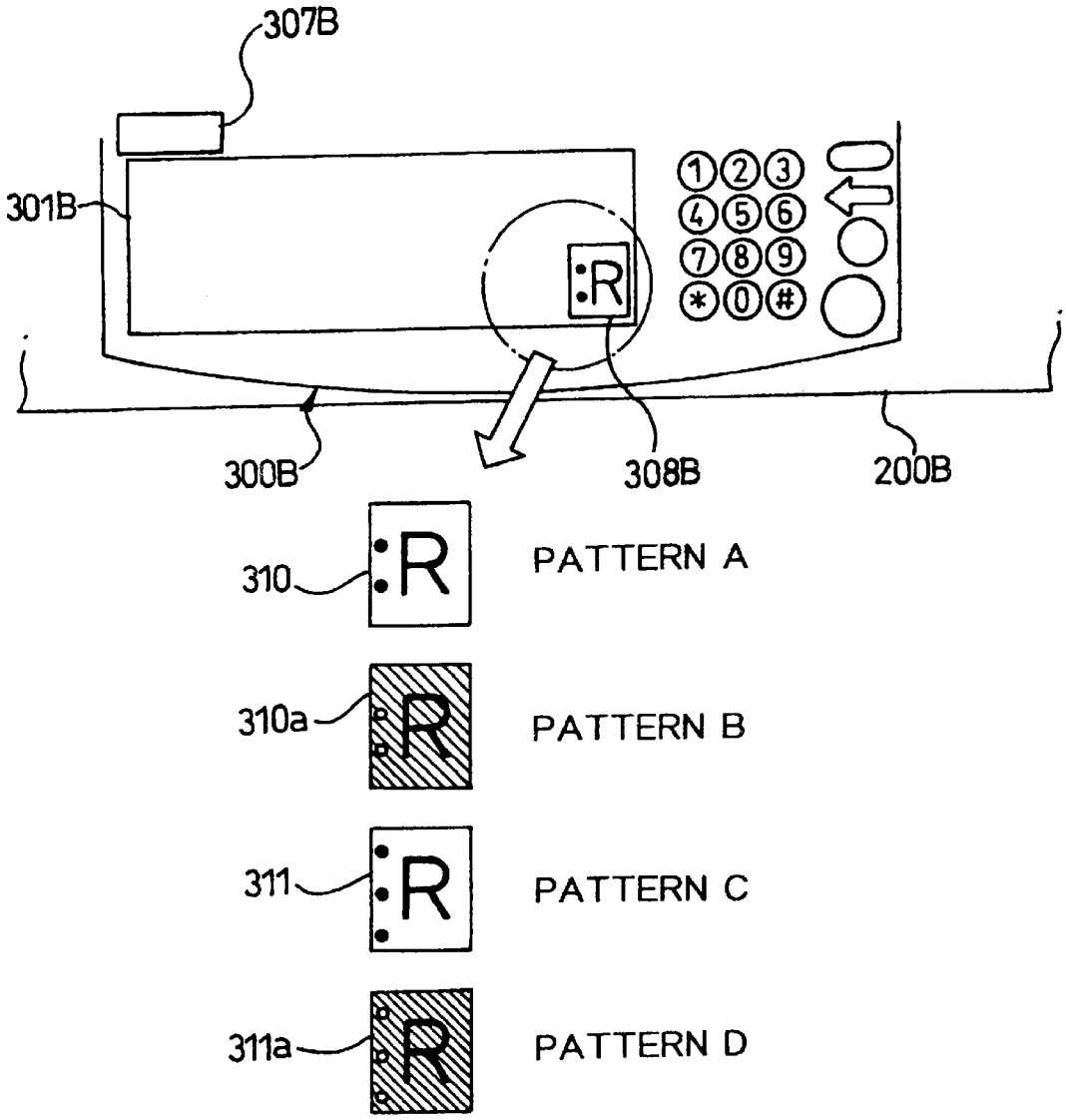
Figure 14:
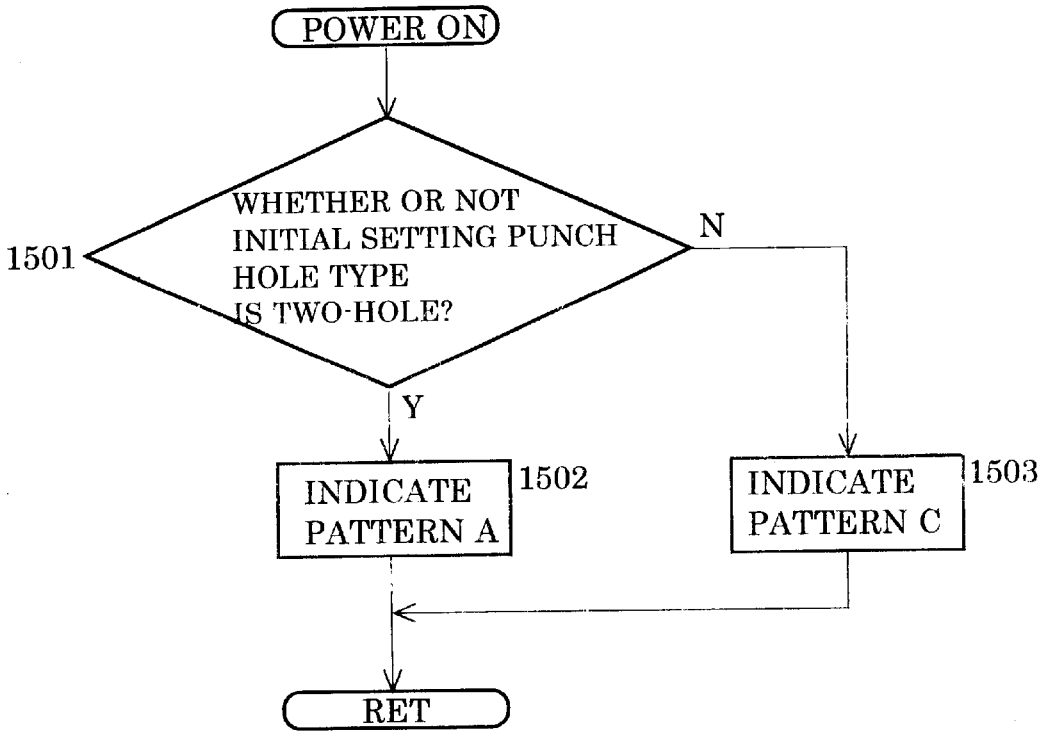

FIG. 13 and FIG. 14 show another embodiment of the image forming apparatus of the present invention.

This image forming apparatus is constituted similarly to the image forming apparatus described with reference to FIG. 1 to FIG. 11. However, selection of the two-hole punch or the three-hole punch is set to a user setting mode performed by a switch on a body operation section 300B of the image forming device 200B, for example, an initial setting button 307B. The setting information is stored in the non-volatile memory in the image forming controller of the image forming device 200B.

In this image forming apparatus, when the apparatus is connected to the power source and the user presses the initial setting button 307B, the pictograph 310 of two-hole punch shown by the pattern A, for example, is indicated on a punch hole selection section 308B in an indicator 301B of the body operation section 300B as shown in FIG. 13. When the user touches the pictograph 310, the pictograph changes to the pictograph 310*a* with a meshed shade shown by the pattern B.

Further, when the user presses the initial setting button 307B, the pictograph changes to the pictograph 311*a* as shown by pattern C. When the user touches the pictograph 311, the pictograph 311 changes to the pictograph 311*a* with a meshed shade as shown in pattern D.

In the image forming apparatus, since the pictograph of only one kind is always indicated on the punch hole selection section 308B as described and an area occupied by the indicator 301B is small, the indication at the punch hole selection section 308B can be made large and thus visibility further improves.

FIG. 14 shows an indication process performed by the image forming controller. When the image forming apparatus is connected to the power source, the processor of the image forming controller checks whether the punch hole type set by the initial setting button 307 is the two-hole punch (step 1501). If the setting is the two-hole punch, the image forming controller reads out information regarding the pictograph 310 of two-hole punch shown by the pattern A of FIG. 13 from the non-volatile memory, and indicates it on the punch hole selection section 308 (step 1502).

If the punch hole type designated by the initial setting button 307 is the three-hole punch, the image forming controller reads out information regarding the pictograph 311 of three-hole punch shown by the pattern C of FIG. 13 from the non-volatile memory, and indicates it on the punch hole selection section 308 (step 1503).

When the user selects either one of the pictographs 310 and 311 indicated, the image forming controller reads out information regarding the pattern B or the pattern C from the non-volatile memory, and changes the indication of punch hole selection section 308 to the pictograph 310*a* or 311*a* with a meshed shade.

Then, the image forming controller sends the information to the post-processing controller of the paper post-processing device, and the post-processing controller allows the punching device to perform formation of the punch hole type designated by the punch hole selection section 308.

Figure 15:
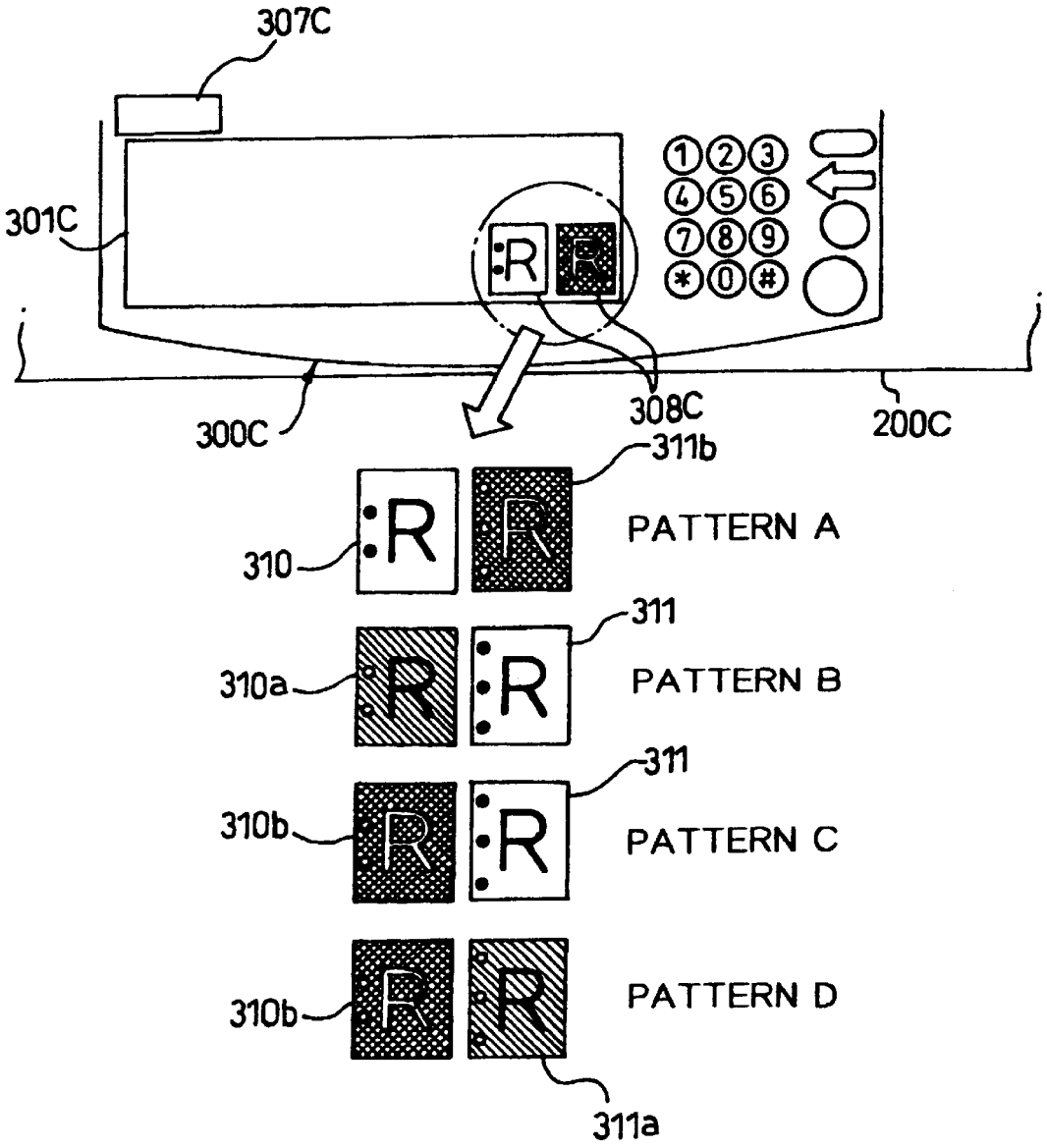

FIG. 15 further shows the body operation section 300 of image forming device in another image forming apparatus.

In this image forming apparatus, two punch hole types are indicated in a punch hole selection section 308C in an indicator 301C of a body operation section 300C of an image forming device 200C. The two punch hole types are the pictograph 310 of two-hole punch that consists of the positive image and the pictograph 311*b* of three-hole punch that consists of the negative image as shown by the pattern A, or the pictograph 310*b* of two-hole punch that consists of the negative image and the pictograph 311 of three-hole punch that consists of the positive image as shown by the pattern C. The pictograph of positive image means that it can be selected by the user, while the pictograph of negative image means that it cannot be selected.

When the user touches the pictograph 310 with a finger while the pattern A is indicated, the indication changes to the pattern B and the pictograph 310*a* becomes a mesh indication. The other pictograph 311 remains to be the negative image.

When the user touches the pictograph 311 with a finger while the pattern C is indicated, the indication changes to the pattern D and the pictograph becomes the pictograph 311*a* of mesh indication. The other pictograph remains to be the negative image 310.

Accordingly, since the punch hole type that can be executed in a image system, the punch hole type that cannot be executed currently and the selected punch hole type are indicated by the pictograph, the user can confirm the punching state at a glance.

Figure 16:
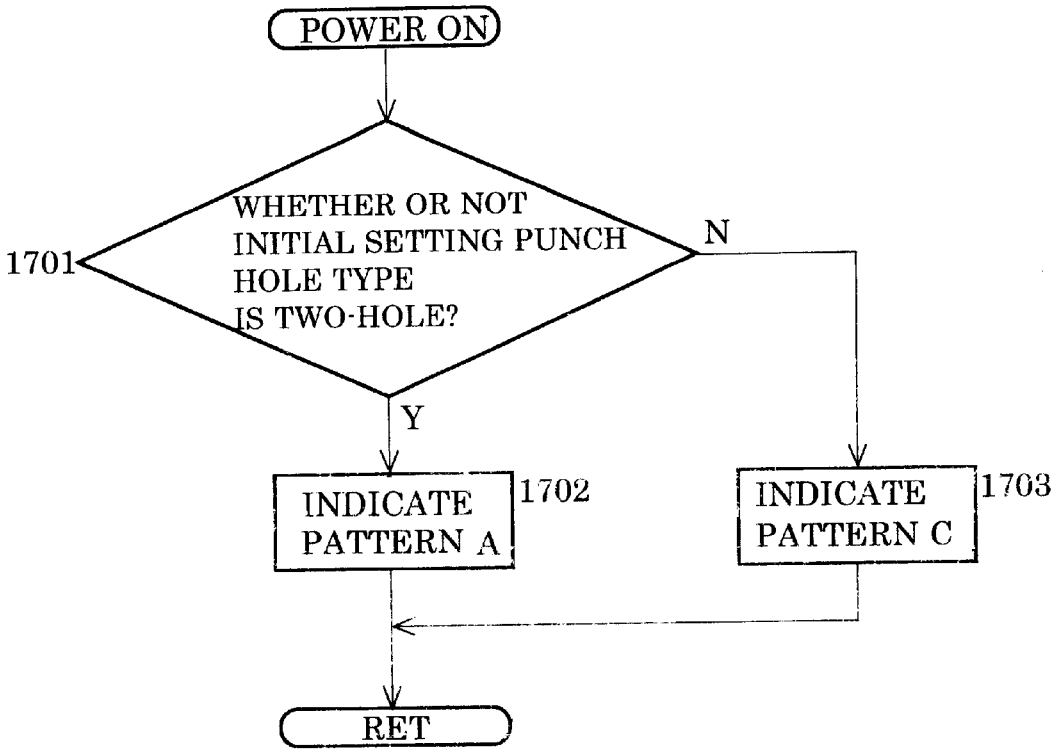

FIG. 16 shows an indication process executed by the image forming controller of the image forming device. When the image forming apparatus is connected to the power source, the processor of the image forming controller checks whether the punch hole type initially set by the button 307C is the two-hole punch (step 1701), and the image forming controller reads out information regarding the pictographs 310 and 311 shown by the pattern A in FIG. 15 from the non-volatile memory if setting is the two-hole punch, and indicates it on the punch hole selection section 308C (step 1702). If the setting is the three-hole punch, the image forming controller reads out information regarding the pictographs 310 and 311 of three-hole punch shown by the pattern C in FIG. 15 from the non-volatile memory, and indicates it on the punch hole selection section 308C (step 1703).

When the user selects either the pictograph 310 of pattern A or the pictograph 311 of pattern C, the image forming controller reads out relevant information from the non-volatile memory to change the indication of punch hole selection section 308C to either the pattern B or pattern D. And then, when the user selects either the pictograph 310 of two-hole punch in the pattern B or the pictograph 311 of three-hole punch in the pattern D, the image forming controller sends information regarding the punch hole selected by the post-processing controller of paper post-processing controller, and the post-processing controller allows the punching device to form holes of the punch hole type designated by the punch hole selection section 308C.

In the foregoing image forming apparatus, although the punch hole type is set in the body operation section of the image forming device, the punch hole type may be set in the paper post-processing device.

FIG. 17 to FIG. 21 show the image forming apparatus provided with such a paper post-processing device.

Figure 17:
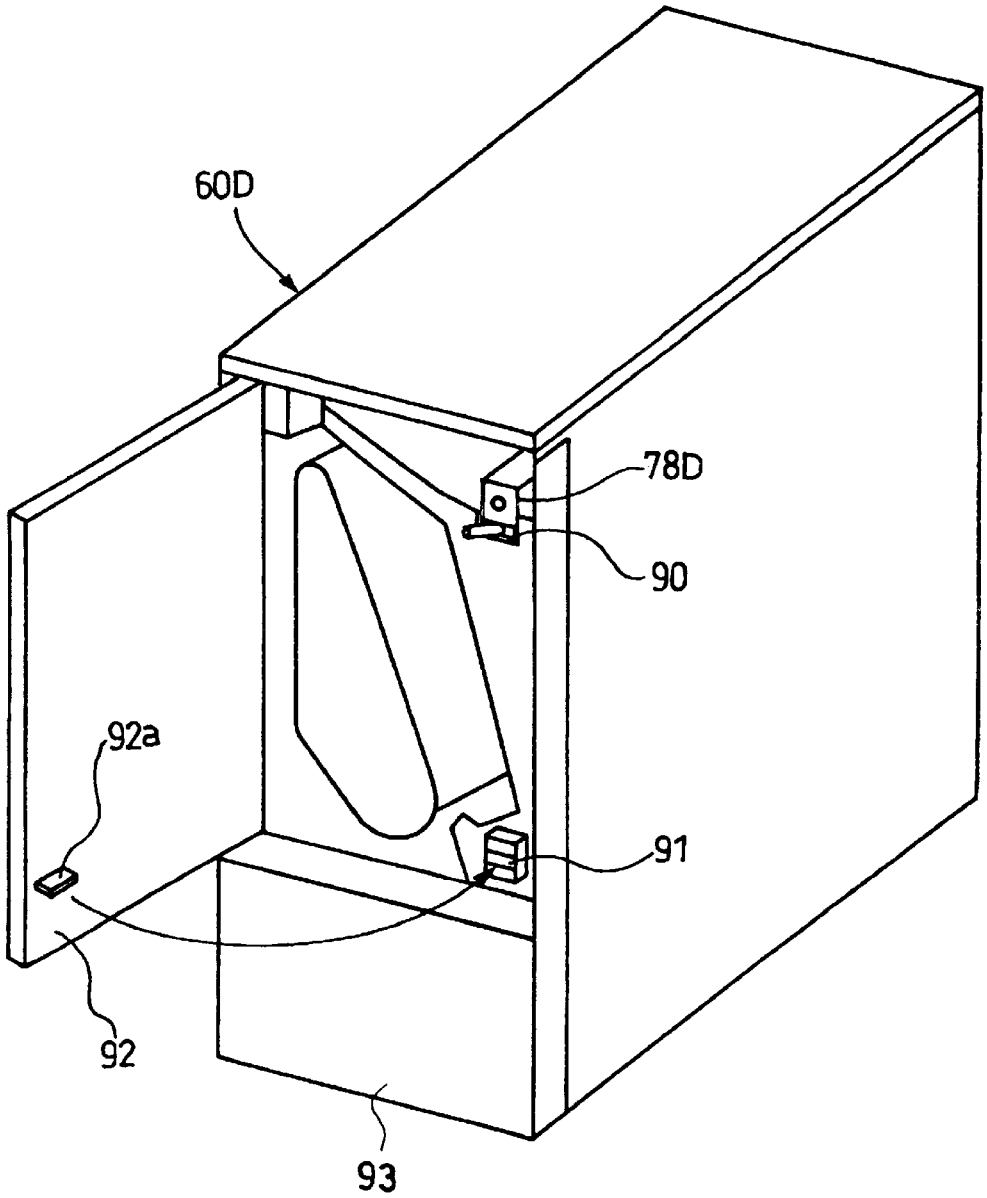

FIG. 17 shows a paper post-processing device 60D of the copier. A device similar to the paper post-processing device 60 described with reference to FIG. 1 to FIG. 11 is built in a case 93 of the paper post-processing device 60D, and a switch 90 to designate the punch hole type is built inside the case 93.

The switch 90 is attached to a punching device 78D, for example, and is exposed to the outside when a door 92 is opened for maintenance and service.

The switch 90 consists of a toggle switch, and can be switched in two positions. The processor in the image forming controller in an image forming device 200D recognizes the punch hole type as the two-hole punch when a lever of the switch 90 is in one position and also recognizes as the three-hole punch when the lever is in another position.

Moreover, a detector 91 is built in the case 93. The detector 91 consists of a proximity switch, for example, and is arranged inside the case 93 facing the door 92. A detecting element 92*a* is attached to the door 92. The image forming controller of the image forming device 200D disconnects the paper post-processing device 60D from the power source when the door 92 is open and the detecting element 92*a* is apart from the detector 91, as shown in FIG. 17, and connects the paper post-processing device 60D to the power source when the door 92 is closed and the detector 91 detects the detecting element 92*a*.

Figure 18:
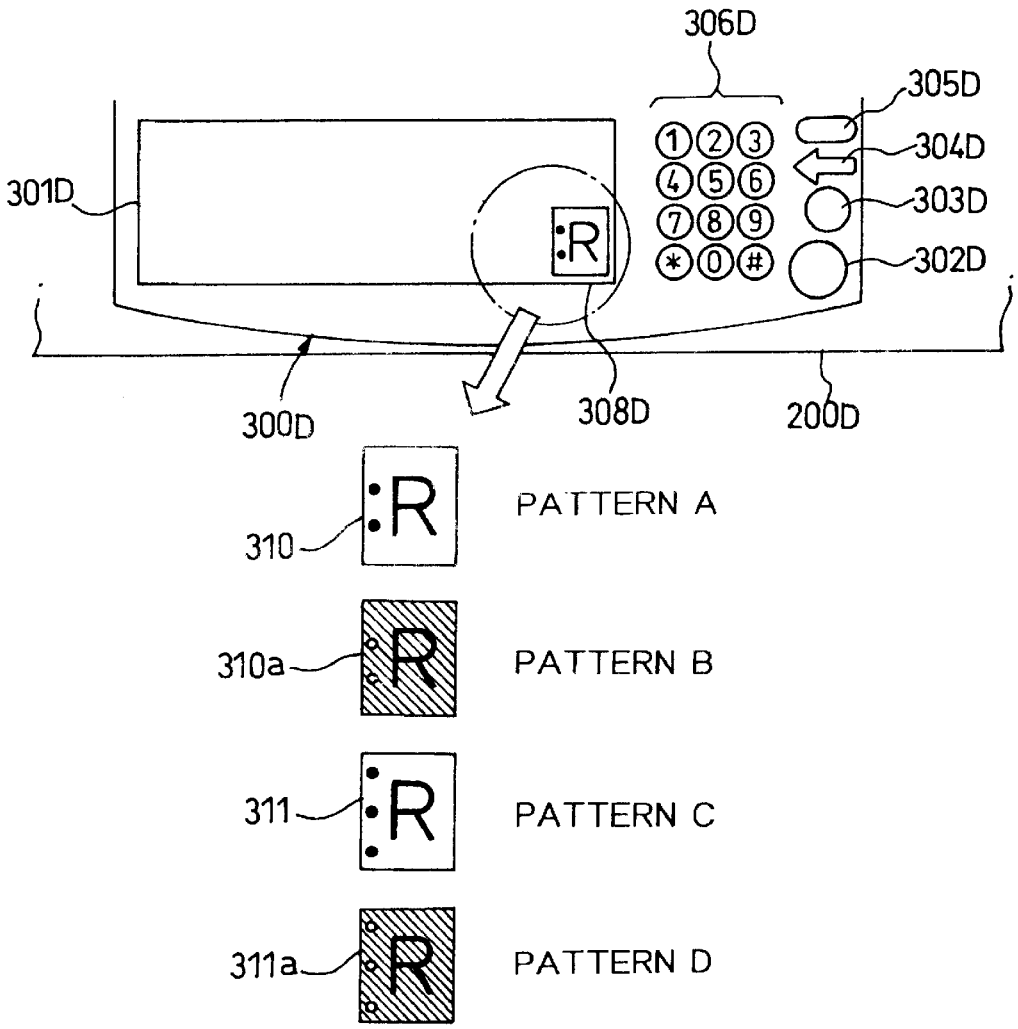

The body operation section 300D of the image forming device 200D, as shown in FIG. 18, comprises: a starting press button 302D; a stopping press button 303D; a interruption press button 304D; a press button 305D to reset setting such as the copy conditions; and ten keys 306D to set a number of copies, enlargement magnification, reduction magnification and the like. However, the body operation section 300D does not comprise the initial setting button.

In a punch hole selection section 308D of the body operation section 300D, the pictograph 310 of two-hole punch in the positive image shown as the pattern A, the pictograph 310*a* as the pattern B, where the pictograph 310 is meshed, the pictograph 311 of three-hole punch in the positive image shown as the pattern C, and the pictograph 311*a* as the pattern D, where the pictograph 311 is meshed are indicated. Data of these pictographs is stored in the non-volatile memory in the image forming controller.

When the image forming apparatus is connected to the power source, the processor of the image forming controller of the image forming device 200D indicates the pictograph 310 or the pictograph 311 in the punch hole selection section 308D in accordance with the initial setting by the switch 90, that is, indicates the punch hole type that can be selected. The user touches the pictograph with a finger if the indicated pictograph is the pictograph corresponding to a desired punch hole type. The image forming controller changes indication of the punch hole selection section 308D to either the pictograph 310*a* or the pictograph 311*a*.

Figure 19:
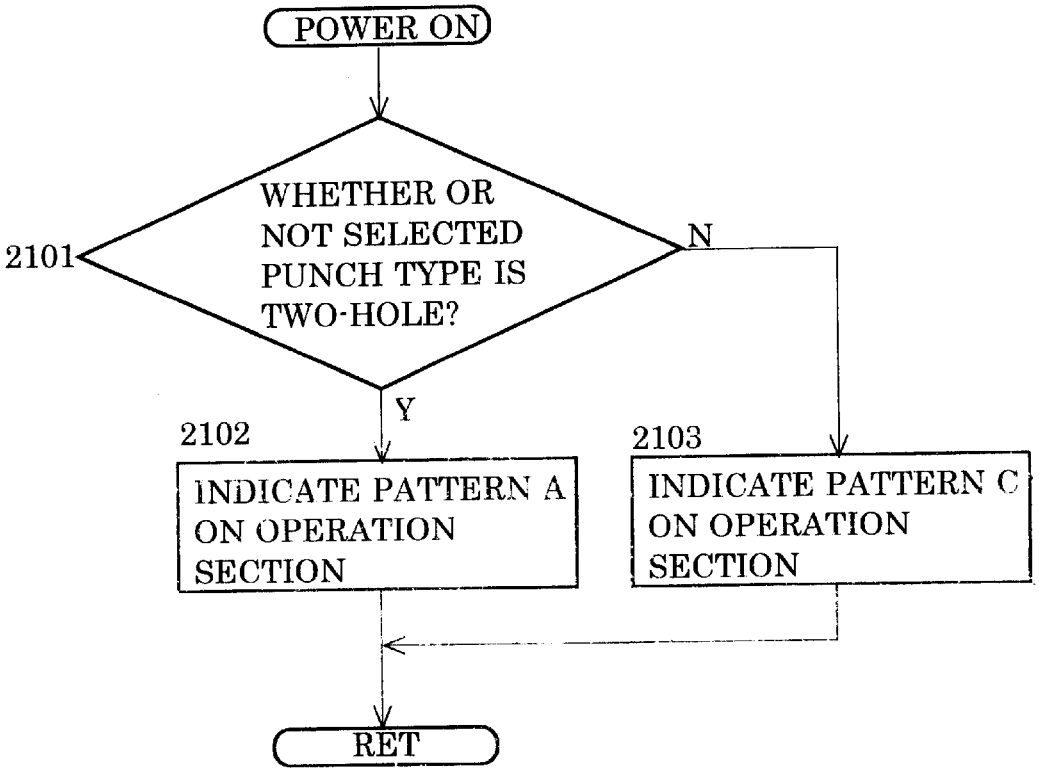

FIG. 19 shows an indication process performed by the image forming controller.

When the image forming apparatus is connected to the power source, the processor of the image forming controller checks whether the punch hole type set by the switch 90 is the two-hole punch (step 2101). If the setting is the two-hole punch, the image forming controller reads out data from the non-volatile memory, and indicates the pictograph 310 shown as the pattern A in the punch hole selection section 308D of the indicator 300D (step 2102). If the setting is not the three-hole punch, the image forming controller indicates the pictograph 311 shown as the pattern C in the punch hole selection section 308D (step 2103).

When the user touches either the pictograph 310 or the pictograph 311 indicated, the image forming controller changes it to either the pictograph 310*a* shown as the pattern B or the pictograph 311*a* shown as the pattern D, and notifies the user of selection completion of the punch hole type. When copying starts, the image forming controller sends the information of the designated punch hole type to the post-processing controller of the paper post-processing device 60D, and the post-processing device allows the punching device 78D to form the punch holes in the paper ejected from the image forming device 200D in accordance with the information.

Furthermore, in the image forming apparatus, the image forming controller checks the open/close state of the door 92 of the paper post-processing device 60D, and indicates the punch hole type selected by the switch 90, that is, the pattern A or the pattern D, in the punch hole selection section 308D of an indicator 310D. Description will be made with reference to FIG. 20 and FIG. 21.

Figure 20:
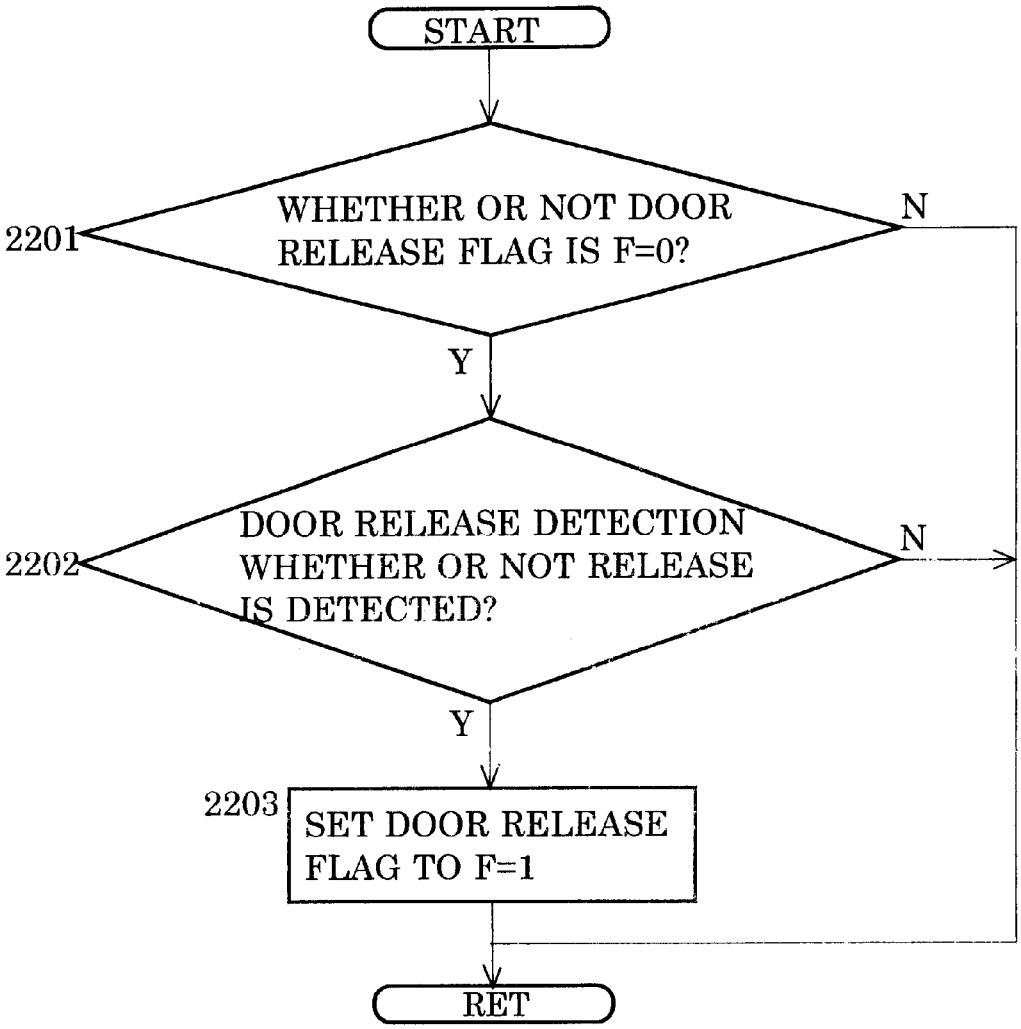

When the user opens the door 92, set the punch hole type by the switch 90, and presses the start button 302D keeping the door 92 open, the processor of the image forming controller checks whether a release flag F of door is F=0 (step 2201) as shown in FIG. 20. When the door release flat F is F=0, the image forming controller checks whether the door 92 is released by a signal from the detector 91 (step 2202), and sets the door release flag F to F=1 if the door 92 is released (step 2203), and then does not connect the post-processing device 60 to the power source.

Figure 21:
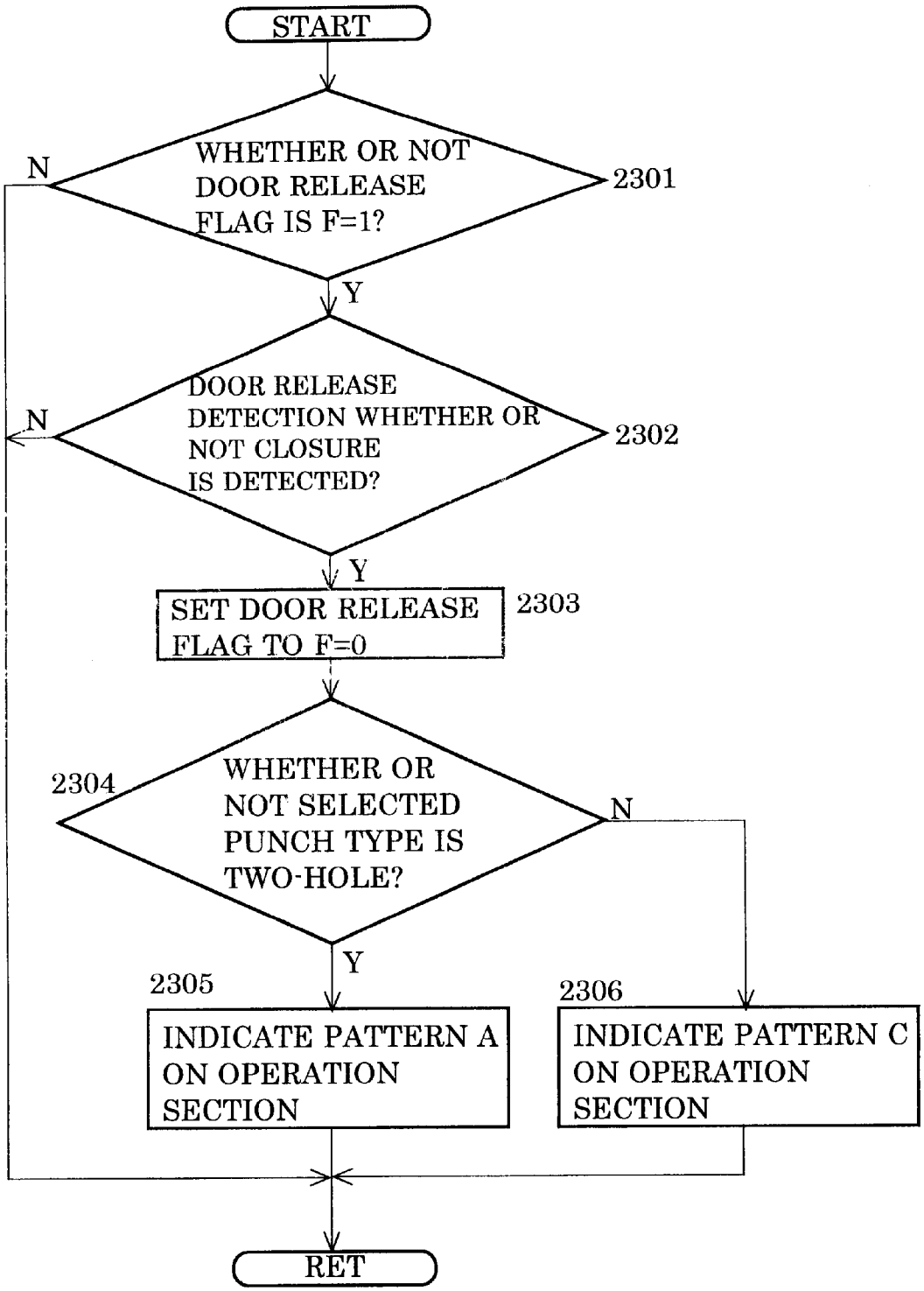

When the user closes the door 92 and presses the start button 302D, the image forming controller checks whether the door release flag F is F=1 (step 2301) as shown in FIG. 21, and when the door release flag F is F=1, the controller checks whether the sensor 91 detected closing of the door 92 (step 2302).

When the door 92 is closed, the image forming controller sets the door release flag F to F=0 (step 2303). Then, the image forming controller checks whether the punch hole type set by the switch 90 is the two-hole punch (step 2304), and indicates the pictograph 310 as the pattern A shown in FIG. 18 in the punch hole selection section 308D if it is the two-hole punch (step 2305), and also indicates the pictograph 311 as the pattern C shown in FIG. 18 in the punch hole selection section 308D if it is the three-hole punch (step 2306). When the user touches the indicated pictograph, the image forming controller changes the pictograph 310 of positive image to the meshed pictograph 310*a* or changes the pictograph 311 of positive image to the meshed pictograph 311*a*, and shows the user the selection completion of punch hole type. Then, the image forming controller transmits the information regarding the designated punch hole type to the post-processing controller, and the post-processing device allows the punching device 78D to perform the formation of designated punch holes.

As described, when this image forming apparatus indicates the punch hole type that can be executed currently on the indicator 301D as the pictograph 310 of positive image or the pictograph 311*a* and designates the punch hole type, it changes these pictographs 310 and 311 to the pictographs 310*a* and 311*a* of meshed indication. Accordingly, the user can easily know the set punch indication and designated punch hole type. Furthermore, since the paper post-processing device 60D is disconnected from the power source even if the user forgets to close the door 92 after the punch hole type has been set to the paper post-processing device 60D, change of the punch hole type can be surely and safely performed.

Note that the foregoing embodiments have been described only for switching between the two-hole punch and the three-hole punch, but switching between the two-hole punch and the four-hole punch can be performed in the same manner. Further, although indication of the punch hole type is indicated on the indicator in the body operation section of the image forming device, it may be indicated only on the paper post-processing device or on both the image forming device and the paper post-processing device. Moreover, although indication of the punch hole type is performed by the image forming controller of image forming device, it may be performed by the post-processing controller of paper post-processing device. Still further, although the controllers are in both the image forming device and the paper post-processing device, they may be integrated in one controller to control both the image forming device and the paper post-processing device.

What is claimed is:

1. An image forming apparatus comprising:

an image forming device;

an indicator; and a post-processing device having a punching device that forms punch holes of a plurality of types on a paper ejected from the image forming device, wherein the indicator indicates one of pictographs corresponding to each punch hole type, and indicates an indicated pictograph as a pictograph different from a previous pictograph when the indicated pictograph is selected, wherein the pictograph comprises a bounding rectangle and circles arranged in the bounding rectangle and showing punch holes, and punch hole circles of each pictograph correspond to a number of the punch holes of each punch hole type, and wherein a base pattern of the pictograph indicated later is different from that of the pictograph indicated first.

2. An image forming apparatus comprising:

an image forming device;

an indicator; and a post-processing device having a punching device that forms punch holes of a plurality of types on a paper ejected from the image forming device, wherein the indicator indicates a plurality of pictographs indicating each punch hole type and different from each other, and indicates the pictograph corresponding to a selected punch hole type as a pictograph different from a previous pictograph when the punch hole type is selected, and wherein said pictograph consists of two pictographs corresponding to two punch hole types.

3. The image forming apparatus as claimed in claim 2, wherein each pictograph comprises a rectangular frame and circles showing punch holes arranged in the rectangular frame, and punch hole circles of each pictograph correspond to a number of the punch holes of each punch hole type.

4. An image forming apparatus comprising:

an image forming device;

an indicator; and a post-processing device having a punching device that forms punch holes of a plurality of types on a paper ejected from the image forming device, wherein the indicator indicates a plurality of pictographs indicating each punch hole type and different from each other, and indicates the pictograph corresponding to a selected punch hole type as a pictograph different from a previous pictograph when the punch hole type is selected, wherein of the pictographs indicated first, the pictograph corresponding to the punch hole type that can be selected is indicated in a pictograph different from a pictograph that cannot be selected, and wherein the pictographs indicated first are a positive image and a negative image, and the pictographs indicated later have a base pattern different from the pictographs indicated first.

5. The image forming apparatus as claimed in claim 4, wherein each pictograph comprises a rectangular frame and circles showing punch holes arranged in the rectangular frame, and punch hole circles of each pictograph correspond to a number of the punch holes of each punch hole type.

6. An image forming apparatus comprising:

an image forming device;

an indicator;

a post-processing device having a punching device that forms punch holes of a plurality of types on a paper ejected from the image forming device; and a controller configured to control the post-processing device and the indicator, wherein the controller indicates one pictograph corresponding to a punch hole type on the indicator among the pictographs regarding the punch hole types, indicates the pictograph as a pictograph different from a previous pictograph, and allows the punching device to form the punch holes corresponding to the selected punch hole type when the punch hole type corresponding to the pictograph is selected, and wherein the controller comprises a switch that allows the indicator to indicate the pictographs regarding the punch hole types sequentially.

7. The image forming apparatus as claimed in claim 6, wherein the switch is arranged in the post-processing device.

8. The image forming apparatus as claimed in claim 6, wherein the switch is covered with a cover constituting a part of the post-processing device and is arranged inside the post-processing device, and the post-processing device operates only when the cover is closed.

9. An image forming apparatus comprising:

an image forming device;

an indicator;

a post-processing device having a punching device that forms punch holes of a plurality of types on a paper ejected from the image forming device;

a controller configured to control the post-processing device and the indicator, wherein the controller allows the indicator to indicate a plurality of different pictographs regarding each of a plurality of punch hole types, which is executed by the punching device, and to indicate the pictograph regarding a designated punch hole type as a pictograph different from a previous pictograph, and then allows the punching device to form the punch holes corresponding to the designated punch hole type when the punch hole type is designated, and wherein the controller changes an indicated pictograph on the indicator to the pictograph corresponding to the punch hole type that can be executed based on a paper width to which the image forming device executes image formation, and allows the punching device to form the punch holes based on a changed type.

10. An image forming apparatus comprising:

an image forming device;

an indicator;

a post-processing device having a punching device that forms punch holes of a plurality of types on a paper ejected from the image forming device;

a controller configured to control the post-processing device and the indicator, wherein the controller allows the indicator to indicate a plurality of different pictographs regarding each of a plurality of punch hole types, which is executed by the punching device, and to indicate the pictograph regarding a designated punch hole type as a pictograph different from a previous pictograph, and then allows the punching device to form the punch holes corresponding to the designated punch hole type when the punch hole is designated, and wherein the controller changes an indicated pictograph on the indicator to the pictograph corresponding to the punch hole type which can be executed based on a paper type to which the image forming device executes image formation, and allows the punching device to form the punch holes based on a changed type.

* * * * *